US008523300B2

(12) United States Patent
Najera Bernal et al.

(10) Patent No.: US 8,523,300 B2
(45) Date of Patent: Sep. 3, 2013

(54) DOOR WITH GLASS PANE FOR DRYER

(75) Inventors: Daniel Najera Bernal, Santiago de Queretaro (MX); Roberto Perez Maza, Santiago de Queretaro (MX); Sergio Reyes Miranda, Santiago de Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 239 days.

(21) Appl. No.: 13/110,128

(22) Filed: May 18, 2011

(65) Prior Publication Data

US 2012/0119630 A1 May 17, 2012

(30) Foreign Application Priority Data

May 19, 2010 (MX) ..... MX/A/2010/005581

(51) Int. Cl.
*A47B 77/06* (2006.01)

(52) U.S. Cl.
USPC ..... 312/228; 312/329

(58) Field of Classification Search
USPC ..... 34/603; 49/501; 68/196, 3 R; 126/190–191, 194, 200; 312/228, 326, 329, 312/138.1, 139
See application file for complete search history.

(56) References Cited

U.S. PATENT DOCUMENTS

| | | | | |
|---|---|---|---|---|
| 3,991,520 | A | 11/1976 | Graham | |
| 5,253,433 | A * | 10/1993 | Frey | 34/603 |
| 5,371,956 | A | 12/1994 | St. Louis | |
| 5,819,722 | A * | 10/1998 | Katz | 126/200 |
| 6,499,231 | B1 | 12/2002 | Bradley | |
| 6,558,596 | B1 * | 5/2003 | Bienick et al. | 264/154 |
| 6,561,180 | B1 * | 5/2003 | Austin et al. | 126/190 |
| 6,570,135 | B2 * | 5/2003 | Gros et al. | 126/200 |
| 6,665,984 | B2 * | 12/2003 | Bienick et al. | 49/501 |
| 6,766,596 | B1 | 7/2004 | Bienick et al. | |
| 6,931,761 | B2 * | 8/2005 | Hwang | 34/603 |
| 7,032,350 | B2 | 4/2006 | Bienick et al. | |
| 7,320,186 | B2 * | 1/2008 | Schone | 34/603 |
| 7,559,156 | B2 * | 7/2009 | Renzo | 34/603 |
| 7,614,162 | B2 * | 11/2009 | Renzo | 34/603 |
| 7,802,855 | B2 * | 9/2010 | Calmeise | 312/228 |
| 8,127,464 | B2 * | 3/2012 | Schone | 312/228 |
| 2004/0020246 | A1 * | 2/2004 | Yun et al. | 68/196 |
| 2005/0034486 | A1 * | 2/2005 | Bienick et al. | 68/3 R |
| 2006/0059711 | A1 | 3/2006 | Kim et al. | |
| 2007/0135576 | A1 * | 6/2007 | Ono | 525/192 |
| 2009/0064593 | A1 * | 3/2009 | Ha | 49/400 |
| 2009/0165391 | A1 * | 7/2009 | Kocak et al. | 49/480.1 |
| 2011/0006649 | A1 * | 1/2011 | Caudevilla De Sola et al. | 312/228 |
| 2011/0023559 | A1 * | 2/2011 | Schone | 312/228 |
| 2011/0025177 | A1 * | 2/2011 | Schone | 312/228 |
| 2011/0296630 | A1 * | 12/2011 | Frazer et al. | 312/228 |

FOREIGN PATENT DOCUMENTS

| | | |
|---|---|---|
| CA | 2292732 | 6/2000 |
| GB | 1221343 | 2/1971 |

* cited by examiner

*Primary Examiner* — Hanh V Tran
(74) *Attorney, Agent, or Firm* — Enrique J. Mora; Beusse Wolter Sanks Mora & Maire, P.A.

(57) ABSTRACT

A door with a window for an appliance, such as a clothes dryer, and a method for assembling such a door in the appliance are provided. A tempered glass pane may be supported by one or more packaging structures disposed on borders of the glass pane. Each packaging structure may accommodate a retainer. The glass pane may be sandwiched between an inner frame and an outer frame coupled to one another to form a joined assembly effective to tightly seal the borders of the glass pane.

7 Claims, 18 Drawing Sheets

DOOR WITH GLASS PANE FOR DRYER

RELATED APPLICATIONS

This application claims priority from Mexican application Ser. No. MX/a/2010/05581, filed May 19, 2010, which is incorporated herein by reference in its entirety.

FIELD OF INVENTION

The present application relates to a door or cover for a household appliance with a sole glass piece and more specifically to a reversible door or cover for a dryer which has a single glass pane, as well as the assembly pieces for said door or cover.

BACKGROUND

It is common for door or cover assemblies for household appliances, especially those in washers and dryers, and more specifically in the field of dryers, to have a window with at least two layers, where as an example, the two layers can be two glass panes, an inner glass pane which is in contact with the textiles and an outer glass pane which can have contact with the operator, or yet a glass pane as an inner window and a thermoplastic polymer laminate such as polycarbonate as an outer window. The advantage of having two layers on the window of the door or cover of the dryer is that it can protect the operator from exposure to the high temperatures generated during the drying cycle in the dryer's interior, thus avoiding exposing the operator to possible burns by being in direct contact with the dryer's window.

Additionally, one of the problems which can arise on the doors or lids in the previous art is that the doors or lids of household appliances, especially of dryers, can be non-reversible.

It is common that the operator realizes after comparing his dryer that in light of its proximity to other objects, such as can be a wall, the opening of the door or cover be an obstacle.

Patents which have a double glass pane for dryers are known in the previous art. For example, U.S. publications Nos. 200402246 and 2005034486 and Korean publication No. 20030062172, make known doors for dryers with a window composed of two layers. It is common for washers to have a door or cover present with a single glass pane. For example, U.S. Pat. Nos. 6,665,984 and 7,032,350 make known a door or cover defined by a tempered glass bordered by an encapsulation similar to an open frame made of a molded and injected copolymeric/polymeric synthetic plastic material, preferably an acrylic/styrene/acrylonitrile mixed with glass beads with mica. The inner periphery of the encapsulation of the door or cover is relatively wide which securely adheres and reinforces to the outer periphery border of the tempered glass panel, an outer periphery skirt, a rear handle among others.

U.S. Pat. No. 6,766,596 makes known a door or cover, which includes a tempered for a household appliance, such as a washer or a dryer, which includes a tempered glass panel over an inner surface over which one or two inlayed borders are applied by a ceramic pressing means which define a substantially opaque periphery border which delineate a central area to be viewed through which the clothes in the dryer or washer can be seen when the door or cover is closed. A wide encapsulation molded by injection or border, surrounds the border of the tempered glass panel and creates a water seal for the same. A third means of ceramic pressing formed according to security instructions or rules are applied to the first or second means of pressing but are not discernible from the outside when the door or cover remains closed. When the door or cover is opened, the security instructions or rules are completely visible and readable. This invention makes known a first layer which is a glass pane and two subsequent layers of the pressing means, such as is shown in FIGS. 6 and 7. Additionally, as opposed to this patent, the present invention has a fastening means for the glass pane itself for horizontal load doors, such as those used in dryers and not washers as is shown in said patent.

Hinges for reversible doors are known in the previous art. For example, U.S. Pat. No. 5,253,433 makes known a mounting arrangement for a reversible dryer's door in which a hinge assembly annexed to the dryer cabinet's door includes at least two time hinges, each one having a fixed hinge sheet and annexed to the door and a fixed detachable sheet hinge annexed to the cabinet. Each detachable sheet has a pair of holes placed vertically. The reduced portion of the upper hole extends from the lengthened portion. The reduced portion of the lower hole extends towards under the lengthened portion. Mounting holes are provided in the cabinet's front walls on both sides of the access opening, aligned in accordance with the reduced portions of the upper and lower hole openings. The door is mounted by partially inserting a mounting screw in the upper part of the hole on the selected side of the cabinet. The lengthened portion of the upper opening on the sheet is passed through the mounted screw's head and allowed to drop. When the upper border of the hole's reduction portion bumps with the screw's pointed part, the door is aligned for the insertion of the remaining mounting screws. To make the mounting reverse, the door is disconnected and the screws annexed to the detachable screws from the cabinet are removed and the door is inverted and annexed on the side opposite the access opening as was previously described. Another document to consider is the summary and figures of Japanese Publication No. 2001009192.

On the other hand, safety clasps for reversible doors are also made known in the previous art. For example, European patent No. 0 610 824 makes known a safety clasp for a household dryer for clothes which has a lid for the door with a spring action closure mechanism. The closing plate undergoes a sliding action element and has a dual position security device to prevent the use, or to ensure the door when the appliance is turned on The dryer has a large opening and a respective door with a handle. It is reversible, as are the screws for the hinges or the door closure. The dryer is turned on only when the door's projection is turned oppositely and is completely pressed to the groove of the before mentioned opening. Other safety clasps of lesser importance are those made known in U.S. Pat. Nos. 3,991,520 and 7,159,910.

Thus, the previous art does not make known a door or cover for a household appliance, specifically for a dryer, which has a single glass pane and which is reversible. In the same way, previous art does not make known a method to reverse the door or cover for a single glass pane for a dryer.

BRIEF DESCRIPTION OF THE INVENTION

The present invention relates to a door or cover comprising a single glass pane which is reversible for household appliances, especially for dryers. It is known in the field, that when it is turned on, and in light of the high temperatures necessary to undergo drying, the dryer, specifically certain parts of the cabinet and the inner part of the dryer, such as the drum and the dryer's door or cover tend to elevate its temperature. Specifically, the temperature of these parts of the dryer is elevated by being in contact with the clothes which are being heated. It is common in the field that a space be provided to better visualize the inner contents of the drum, basket or similar to the door or cover of the dryer. In light of the vast majority of dryers being front loading, that is to say, the access to the drum, basket or similar is by means of a door in the frontal area of the dryers, it is common that this space to visualize the inner content of the drum be present in the frontal area. Thus this space to visualize the inner content does usually not have a height greater than one meter and can be easily accessed by different operators. Upon heating, the door also heats this space to visualize the inner content, which is why, if the temperatures in this space are not controlled, it is easy to burn the operator if he touches the space meant to visualize.

Thus it is desirable to have doors or covers for dryers with spaces to visualize the inner content of a dryer which are safe for the operators. In a similar manner, it is desirable to have doors or covers for dryers with spaces to visualize the dryer's inner contents which do not substantially increase the selling cost of said dryer. Thus, it is ideal to have doors or covers for dryers with spaces to visualize the inner content for a dryer which are easy to assemble and which contain few higher cost pieces. Additionally, it is desirable to use doors or covers for dryers with spaces to visualize which are reversible.

The present invention focuses on resolving all of the previously mentioned deficiencies in the same door or cover for the dryer. That is to say, the present invention's door or cover is a door or cover for a dryer with a low production cost, which has a space to visualize the dryer's inner content, which has a high safety factor for the operator, where the temperature levels of the parts which could potentially be in contact with the operator remain within the specified levels, and which has long durability and which is also reversible.

The door or cover assembly for dryers in the present invention comprises an inner door or cover, an outer frame and a tempered glass between the inner door or cover and the outer frame. The inner door or cover fastened unto the tempered glass by means of at least four retainers and at least four screws which fasten unto the retainers of the door or cover. The retainers exert a constant pressure on the tempered glass, pressure which is translated into force which said tempered glass exerts as a constant pressure unto a seal on the inner door or cover's inner face. The seal is coupled to the inner door or cover's inner face by a plurality of grooves distributed near the border or outer perimeter of the inner face, which anchor the seal to the inner door or cover's inner face. The compression forces between the inner door or cover and the tempered glass, and the back compression force between the cabinet, specifically the dryer's front panel, and the inner door or cover's seal, avoids air leaks from the dryer's interior and guarantees a uniform seal. Packaging is present between each one of the retainers and the tempered glass to avoid contact between the retainers and the tempered glass. Specifically, the packaging surrounds at least a part of the tempered glass border. Conversely, an outer frame is fastened to the inner door or cover by means of at least six screws distributed along the length of and close to the border of the outer frame and are received by holes on the inner door or cover. The handle is mechanically assembled to the outer frame.

The door or cover assembly for dryers of the present invention additionally comprises at least two hinges assembled unto the two lateral walls of the outer frame. Each one of the hinges is fastened unto the outer frame by at least two screws. Finally, the door or cover assembly for dryers of the present invention comprises two plates placed on the outer face of the inner door or cover, specifically in a part near the lateral border, substantially central on the outer face. One of the two plates is a plate with two grooves, while the second plate has at least three grooves. Both grooves of the first plate and two grooves of the second plate are grooves which allow for the fastening of the plates unto the outer face of the inner door or cover. One groove of the second plate is capable of receiving and fastening unto a safety clasp. When the door or cover is in a closed position, the safety clasp prevents the opening of the door or cover.

Thus, it is an aspect of the present invention to provide a door or cover for a dryer with a space to visualize the inner content of a dryer which is safe for use for the operators.

Another aspect of the present invention is to provide a door or cover for dryers with a space to visualize the inner content of a dryer which does not substantially increase the selling price of said dryer.

Another aspect of the present invention is to provide a door or cover for dryers with a space to visualize the inner content of a dryer which is easy to assemble and which contain few high costing pieces.

Yet another aspect of the present invention is to provide doors or covers for dryers with a space to visualize the inner content of a dryer where the doors or covers are reversible.

Other aspects and advantages of the present invention will become apparent when the description is referenced along with the following figures.

BRIEF DESCRIPTION OF THE FIGURES

The particular characteristics and advantages of the invention shall become apparent when the description is referenced along with the following figures, where.

DETAILED DESCRIPTION OF THE INVENTION

The use of the term "approximately" provides an additional determined range. The term is defined in the following manner. The additional range provided by the term is that of approximately +10%. As an example, but not limited to, is it states it is "approximately 25°", the exact range lies between 23.5 to 27.5°.

Figure 1:
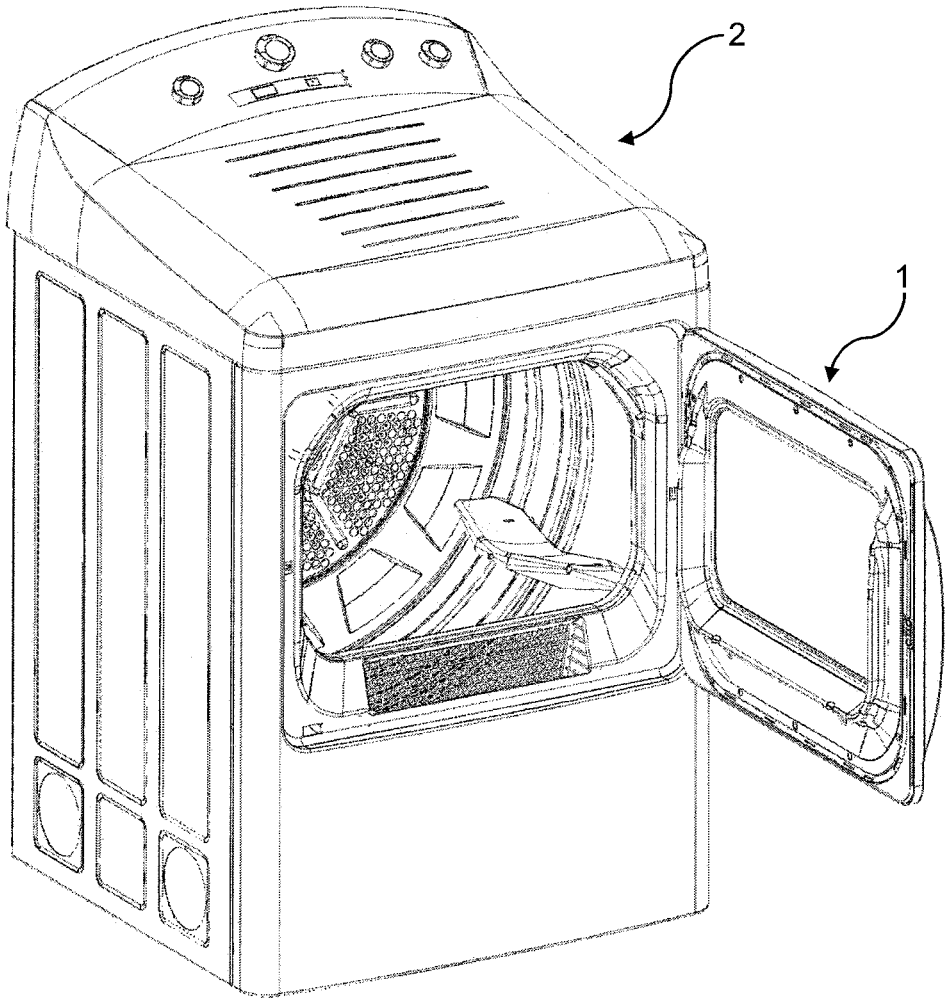
FIG. 1 is a conventional view in perspective of a front loading washer with the door of the present invention.

The present invention refers to doors or covers for household appliances. Specifically "doors or covers" shall be mentioned from here on after solely as "doors 1", however it should not be limited by any reason to doors for this invention, and it should be considered that the same characteristics are applicable for covers. The preferred household appliance for the present invention is household dryers 2, such as can be seen in FIG. 1. However, other household appliances which use heat as their source of heating or drying can be included, such as ovens, dishwashers and industrial clothes dryers. Additionally, the materials used to manufacture the door of the present invention can be substituted depending on the household appliance and depending on the needs of the operator. For example, plastic parts used in the present invention can be substituted by metal parts if it is foreseen that the door will be subject to temperatures higher than the smelting temperature of certain plastics. The fastening means used in the present invention can be those that exist in the field, such as coiled, for example, like in conventional screws. Other fastening means available can be used, so that the type of fastening means is not seen as limitative.

FIRST EMBODIMENT

The following description makes general reference to FIGS. 2 through 5A.

In the present invention, a door for household appliances is made known, preferably one for dryers 2. The dryers 2 can be front loading, such as the one shown in FIG. 1, or rather can be top loading or inclined as was known in previous art.

Figure 2:
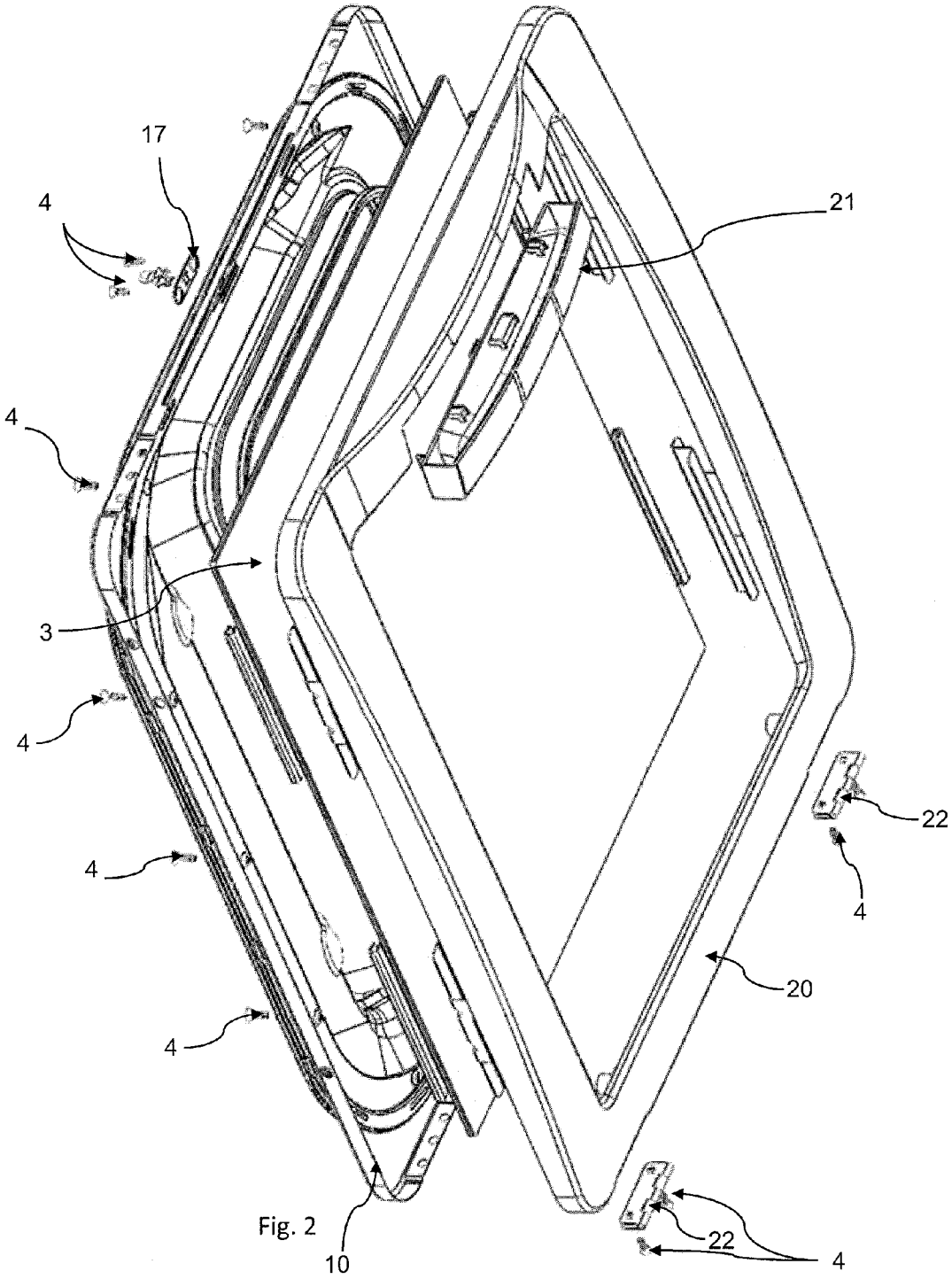
FIG. 2 is an exploded conventional frontal view in perspective of the door or cover of the present invention.
Figure 3:
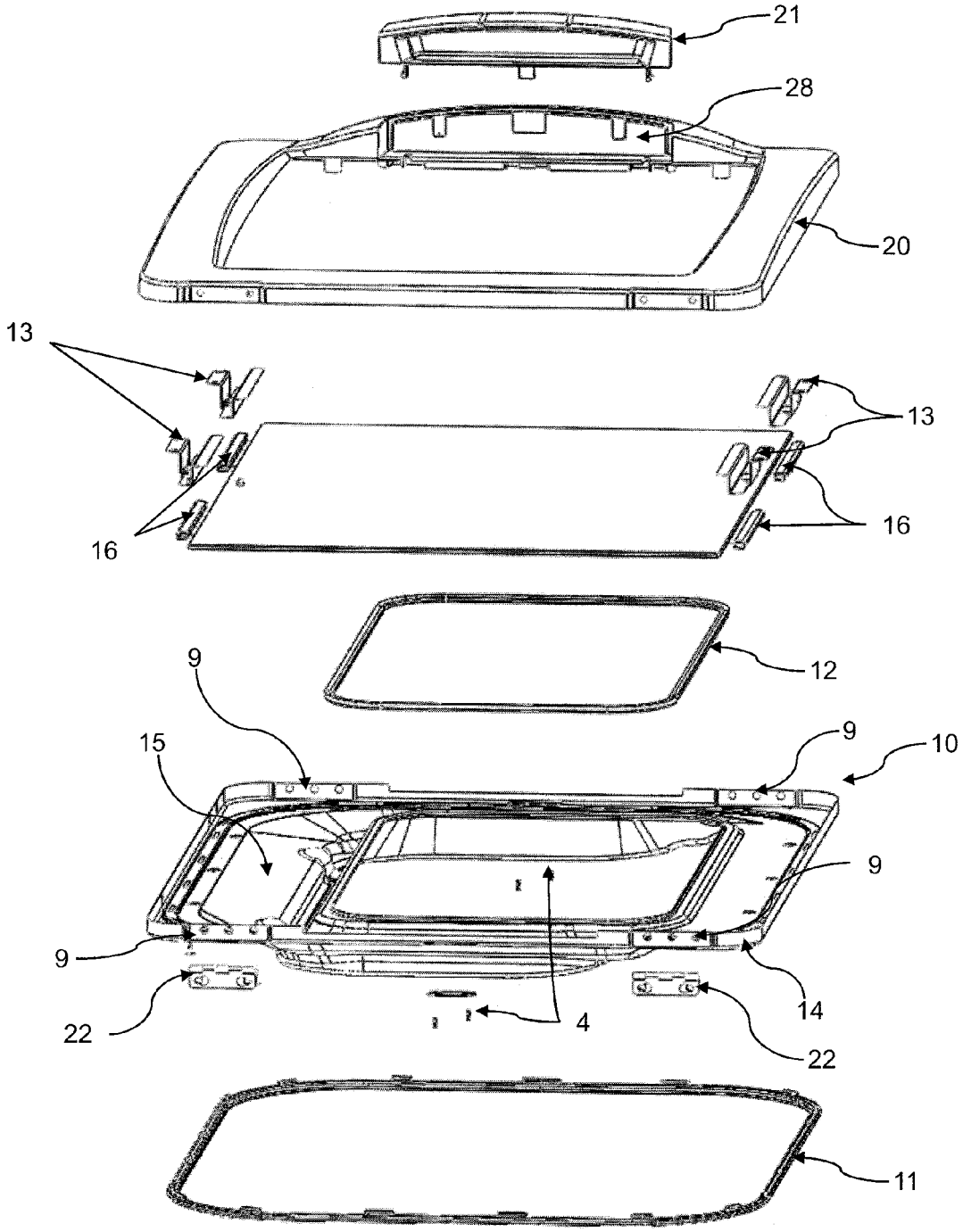
FIG. 3 is an exploded lateral conventional view in perspective of the door or cover of the present invention.

The main parts of the door 1 are an inner frame 10, an outer frame 20 and a tempered glass pane 3 between the inner frame 10 and the outer frame 20. FIGS. 2 and 3 are views in explosion which show the outer frame 20, the inner frame 10 and the tempered glass 3 and the union between all these parts. Such as its name denotes, the outer frame 20, when the dryer door 1 is closed is outwardly oriented in relation to the dryer 2, while the inner frame 10 is inwardly oriented in relation to the dryer 2 when the door is on a closed position.

FIGS. 2 and 3 show the majority of the components necessary for the first embodiment. Thus, the inner frame 10, the outer frame 20 and the tempered glass pane 3 which is found between the inner frame 10 and the outer frame 20 can be seen. Both the inner frame 10 as well as the outer frame 20 has a window 19, 23 in a substantially central part of said frames 10, 20. The inner frame 10 has a first seal 11 applied which faces inwardly unto the dryer 2 when the door is oriented in a closed position, that is, the first seal 11 is placed on the inner face 14 of the inner frame and a second seal 12 is placed on the outer face 15 of the inner frame, same which faces the dryer's 2 exterior when the door is oriented in a closed position. The seal 11 is placed over a gutter which is found in the inner frame 10. The tempered glass 3, which is of a substantially lesser size than the inner frame 10 and of a substantially greater size than the window 19 of the inner frame 10, is placed over a second seal 12, while there are at least four retainers 13 fastened unto the inner frame 10 by means of fasteners 4. The retainers 13 press the tempered glass 3 to the inner frame 10 and more specifically, the retainers cause the tempered glass 3 to be pressed with a force in the direction of the inner frame 10 and against as second seal 12. The retainers 13 are preferably steel. Given that the retainers 13 will usually be made of a material which can scratch the tempered glass 3, a packaging 16 is provided per each retainer 13. Additionally, said packaging can also prevent noise by vibration between the glass 3 and the retainer material 13, decreasing in the same way the magnitude of thermal shock between the glass 3 and the retainer 13, which as previously mentioned, is preferably made of steel. The packaging will have the same length or be greater than the length of the retainer 13 to avoid contact between the retainer 13 and the tempered glass 3. The packaging 16 surrounds the tempered glass 3 at least partly. The compression forces between the inner frame 10 and the tempered glass 3, specifically between the tempered glass 3 against the second seal 12 in light of the pressure applied by the retainers 13 against the tempered glass 3, and subsequently the inner frame 10 against the dryer's 2 cabinet, specifically the first seal 11 against the dryer's 2 cabinet, avoids air leaks from the dryer's 2 interior to the outside and guarantees a uniform heat seal in the dryer's 2 inner part. Such as is subsequently demonstrated in FIGS. 16 and 16A, an outer frame 20, capable of receiving and fastening to a handle 21 mechanically assembled to the outer frame 20, is fastened to the inner frame 10 by means of the fastening means distributed along the length of and close to the border of the inner frame 10 and are received by assembly holes 34 on the inner frame 10 and receptor cavities 65, possibly coiled, on the outer frame 20. The outer frame 20 covers at least part of the tempered glass 3, and thus also covers the retainers 13, packaging 16 and second seal 12 among others.

Figure 4:
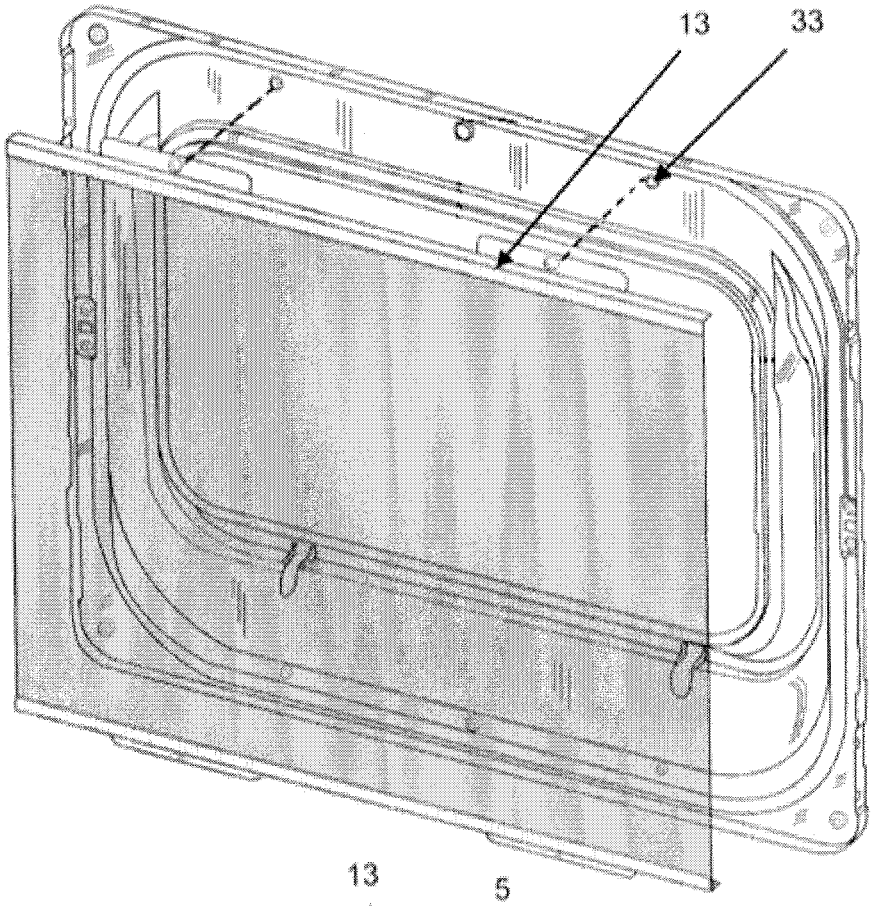
FIG. 4 is a conventional view in perspective of the inner frame and the tempered glass of the present invention.
Figure 4A:
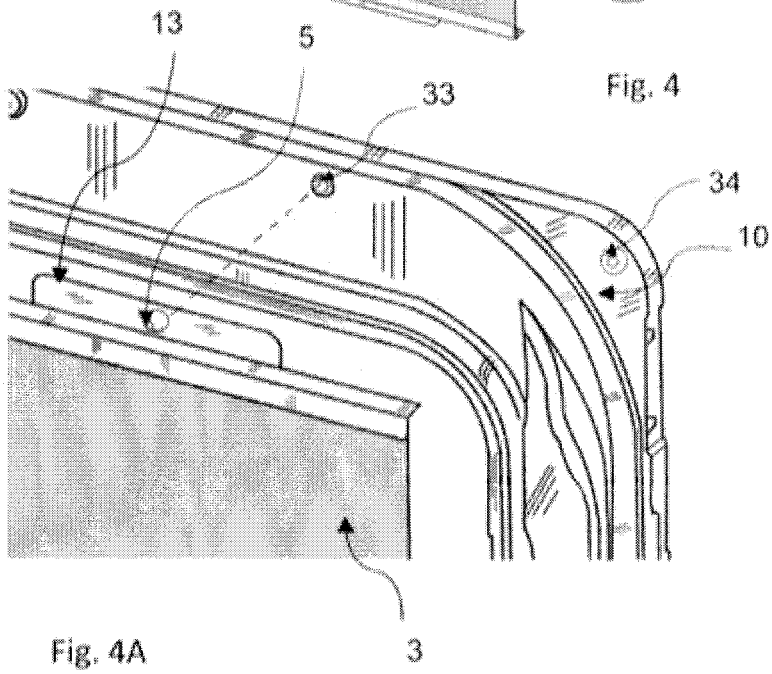
FIG. 4A is a detailed view of FIG. 4.

FIGS. 4 and 4A show how the tempered glass 3 is fastened unto the inner frame 10 by means of the retainers 3. The retainers 13 are fastened by means of fasteners 4 against the inner frame 10. Given that the retainers 13, by means of the packaging 16 (if they are present), fasten the tempered glass 3; the tempered glass 3 creates pressure against the inner frame 10.

Figure 5:
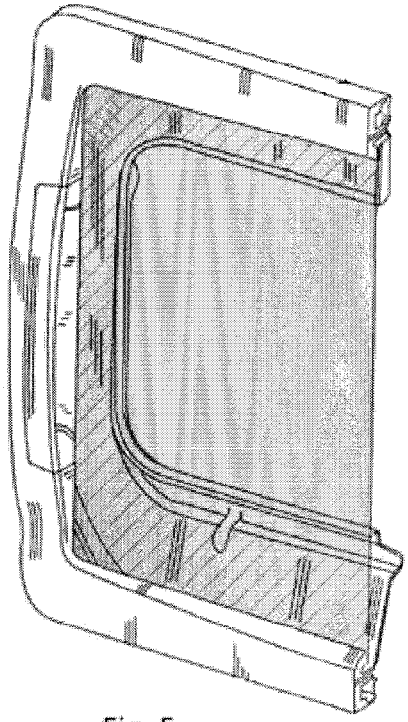
FIG. 5 is a view in conventional perspective of the inner cover of the door or cover with a cross section of the present invention.
Figure 5A:
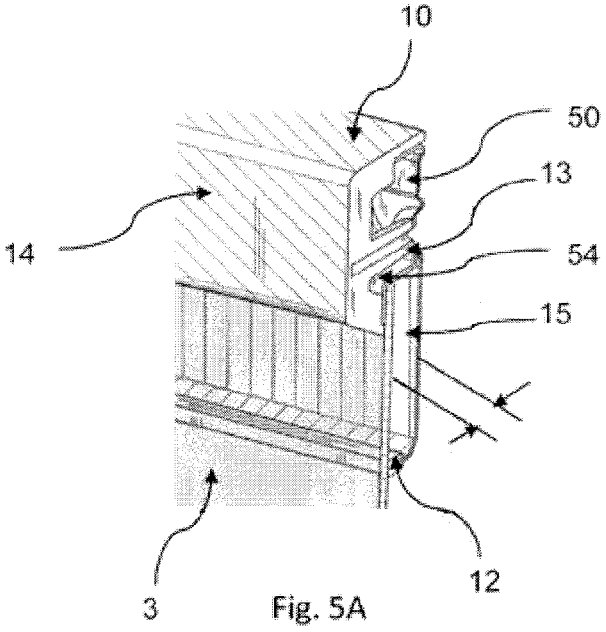
FIG. 5A is a view of a first embodiment of the detailed view in FIG. 5.

FIG. 5 shows a cross section of the assembly between the inner frame 10 and the tempered glass 3, while FIG. 5A shows in detail, what is shown in FIG. 5. FIG. 5A shows that a second seal 12 makes pressure against the tempered glass 3. It also shows the relationship between the tempered glass and a fifth part 54 of the retainer 13. Once assembled, between the tempered glass 3 and at least one part of the outer face 15 of the inner frame 10, a hollow space is left EH1 with the end purpose of allowing the flow of hot air and thus avoiding the door's 1 temperature to increase.

SECOND EMBODIMENT

Figure 5B:
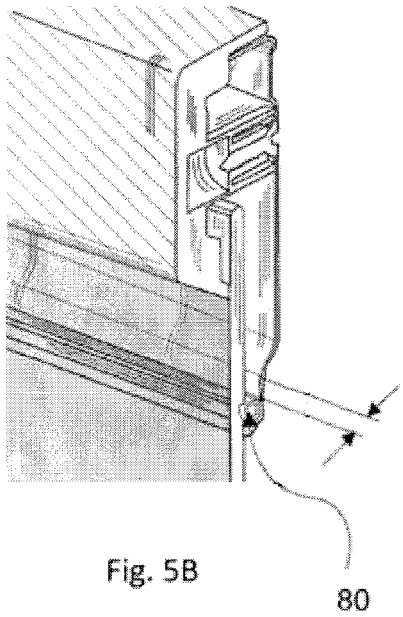
FIG. 5B is a view of a second embodiment of the detailed view in FIG. 5.

In FIG. 5B a second embodiment can be seen. Specifically, in the second embodiment, several pieces can be dispensed with. Specifically, the retainers, the corresponding packaging for the retainers, the fastening means related to the retainers and the second seal, can be dispensed with. Specifically, over a gutter 30 of the inner frame, a constant silicon based strip 80 is provided. The strip has a width of approximately between 0.5 centimeters to 10 centimeters, and is deposited at a constant velocity approximately varying between 120 mm/second to 180 mm/second, preferably approximately between 135 mm/second and 160 mm/second and even more preferably approximately between 145 mm/second and 152 mm/second. The silicon's exit pressure varies approximately between 80 and 92 psi, more preferably between approximately 84 to 90 psi, and even more preferably approximately between 84 to 87 psi.

After the strip 80 deposit over the gutter 30, the tempered glass 3 is deposited over the outer face 15 of the inner frame, specifically over the strip 80, said deposit being at a constant pressure varying between approximately 0.001 kg/cm2 to 0.1 kg/cm2. The temperature at which this deposit needs to be carried out should be room temperature, preferably approximately at 25° C., with a relative humidity varying approximately between 40 to 55%, more preferably between approximately 45 to 52% and even more preferably between approximately 48 to 51%.

GENERAL OBSERVATIONS OF THE INVENTION AND OTHER EMBODIMENTS

Figure 6:
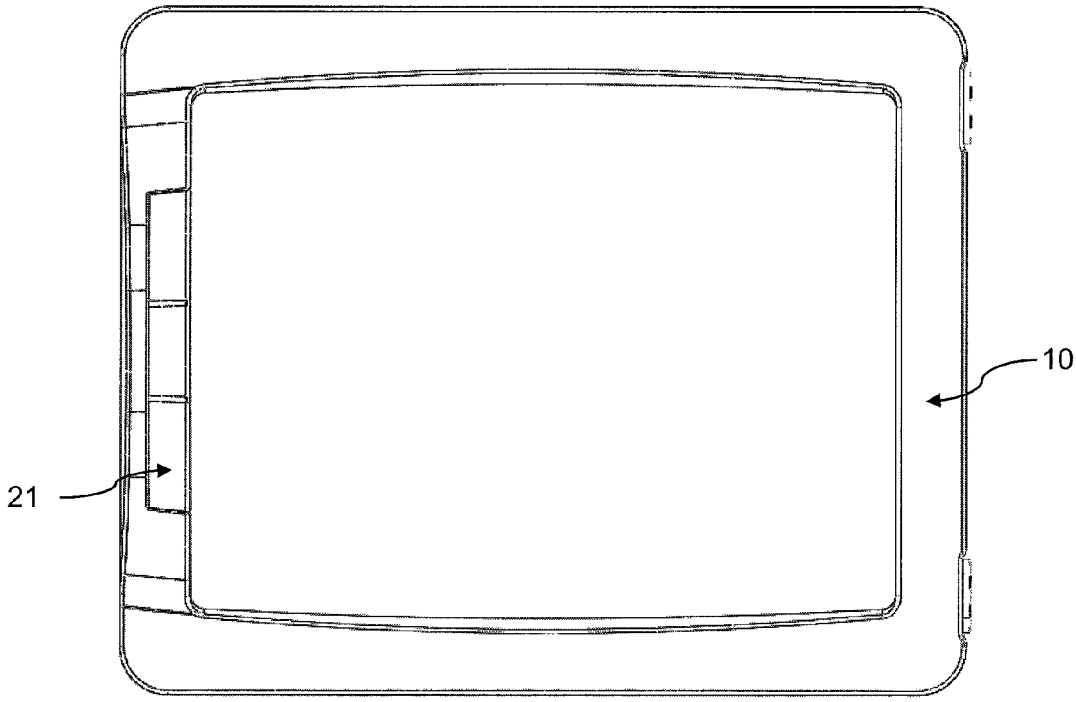
FIG. 6 is a frontal view of the door or cover of the present invention.

FIG. 6 is a view of the outer face of the outer frame 20. Similarly, in the figure, the handle 21 to said outer frame 20 can be identified.

Figure 7:
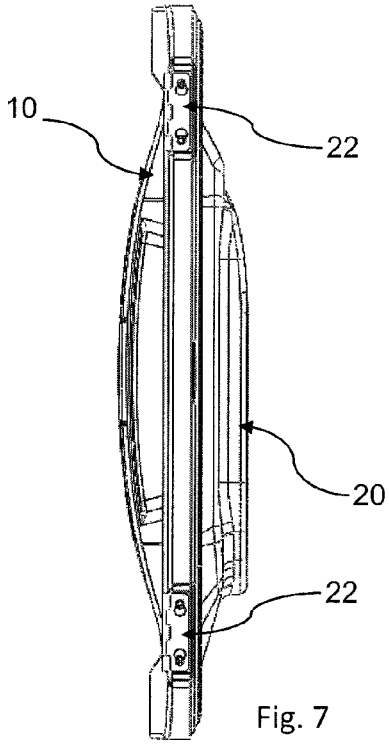
FIG. 7 is a right lateral view of the door or cover of the present invention.

FIG. 7 is a lateral view of both the inner frame 10 as well as the outer frame 20. The hinges 22 can be identified, which by a means of fastening, shall be fastened to said frames 10, 20.

Figure 8:
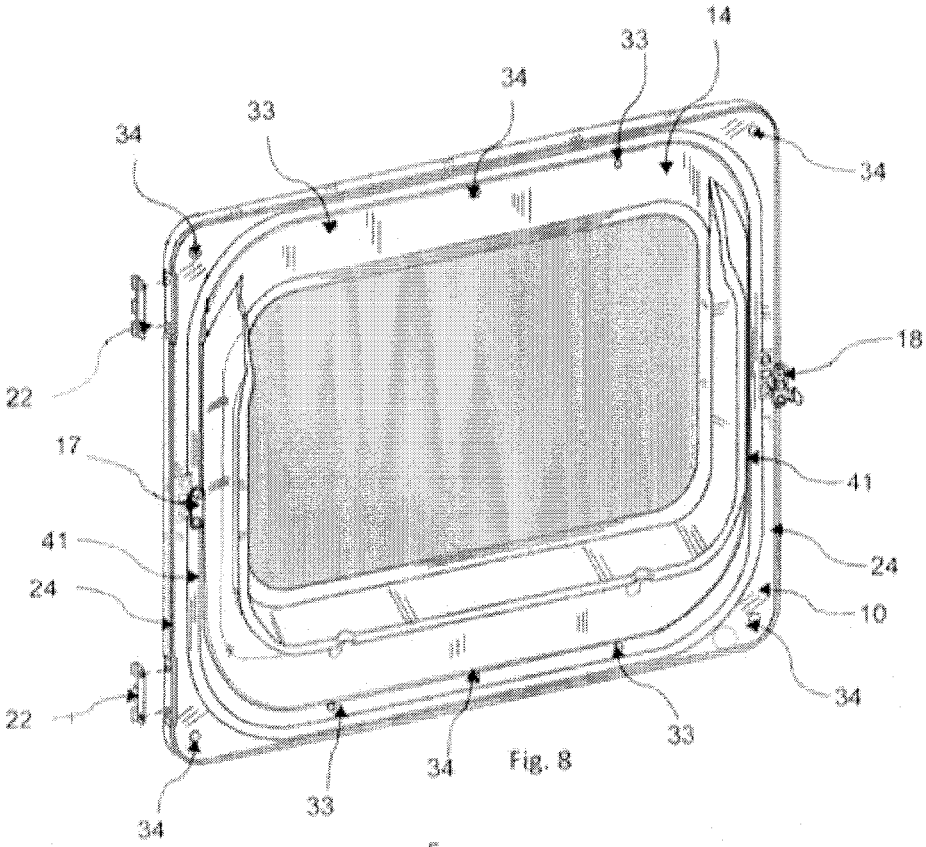
FIG. 8 is a back-side view in conventional perspective of the door or cover of the present invention.
Figure 8A:
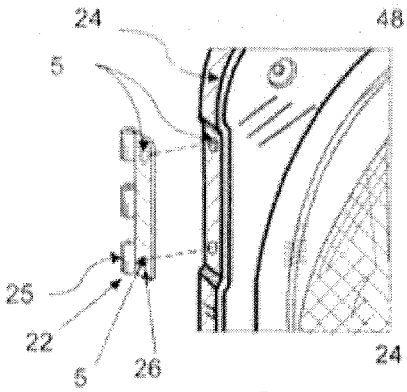
FIG. 8A is a detailed view of a part of the door or cover according to FIG. 8.

Such as can be seen in FIGS. 8 and 8A, on the outer frame 20, specifically on a lateral 24 side of the outer frame 20, two hinges 22 are placed. The hinges 22 are fastened to the lateral side 24 of the outer frame 20 by means of fastening means 4. When they are in mounted position, the hinges 22 of the door will be near the dryer's 2 cabinet, while the handle 21 of the outer frame will be distant from the dryer's 2 cabinet. The hinges 22 can be seen with greater detail in FIGS. 8A and 11A. The hinges 22 comprise two parts 25, 26. The first part 25 is fastened to the door by fastening means 4 and by two holes 5 in said first part, holes 5 which are collinear with cavities 5 on the lateral side 24 of the outer frame 20. On the other hand, the second part 26, which is fastened to the first part 25, is composed of two holes 6, where each one of the two holes 6 is composed of two forms substantially circular, where a first substantially circular form is of a lesser diameter than the second substantially circular form. Both holes are substantially opposed, that is, while as an example, in the upper hole 6 the first form is in the upper part and the second form is in the lower part, in the lower hole, the second form is in the upper part and the first form is in the lower part. The inner frame 10 also has receptor cavities 9 to receive the first part 25 of the hinge. Specifically, the inner frame 10 has receptor cavities 9 in both of its lateral parts, which are substantially opposite between them. This can be seen in FIG. 3.

Figure 8B:
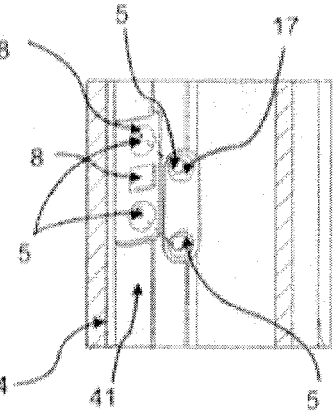
FIG. 8B is a view of a second detail from FIG. 8.
Figure 8C:
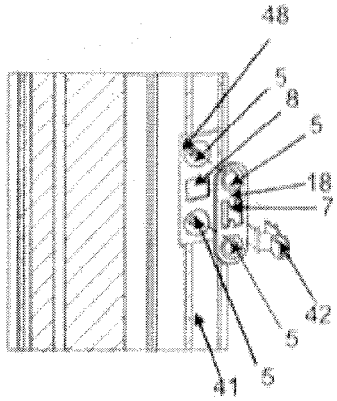
FIG. 8C is a view of a third detail from FIG. 8.
Figure 14:
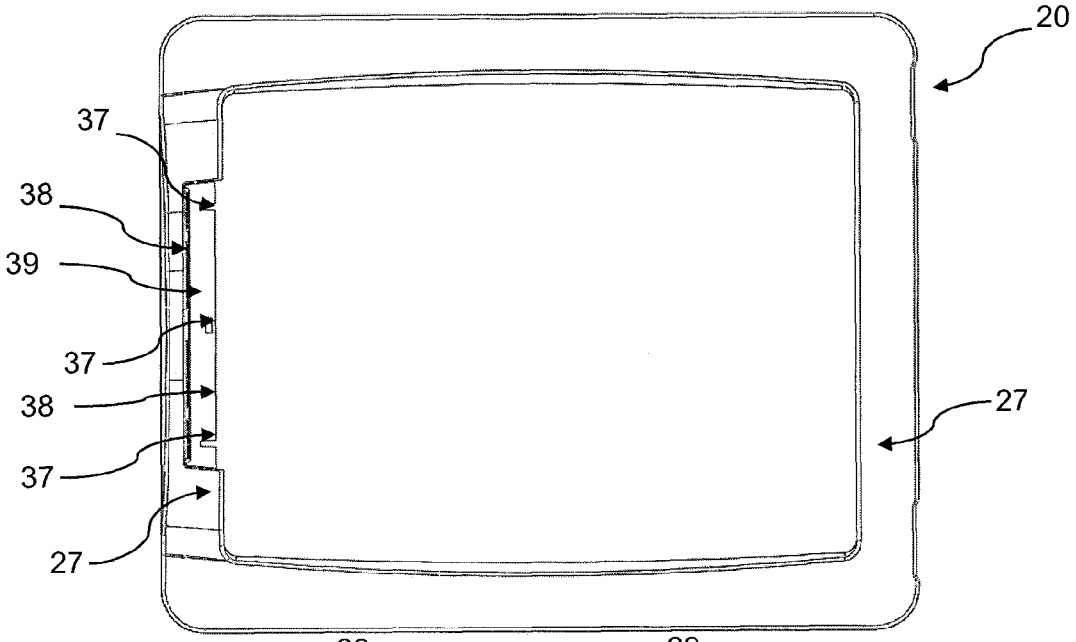
FIG. 14 is a frontal view of the outer frame of the door or cover of the present invention.

Such as can be seen in FIGS. 8 and 8B specifically for the first part of the plate-17 and FIG. 8C, in conjunction with FIG. 14 specifically for the second plate-18, where a first plate 17 with two holes and a second plate 18 with three holes are fastened to the inner frame 10 in a plate receptor space 48. Both plates are fastened to the inner face 14, specifically on the lateral part 41 of the inner face 14 of the inner frame 10. Two holes 5 on the first plate 17, as well as two holes 5 on the second plate 18 are provided so that the fastening means 4 will fasten the plates 17, 18 against the door's inner frame 10. Specifically, each one of the holes 5 in the first and second plate 17, 18 previously mentioned is collinear with a hole of the lateral part 41 of the inner face of the inner frame 10. A third hole 7 of the second plate 18 is provided so that a safety latch 42 be fastened to the door assembly. The second plate 18 and the safety latch 42 can be seen in greater detail in FIGS. 8C and 14. Specifically, the third hole is composed by two substantially parallel sections 43 and one substantially transversal section 44. The safety latch 42 is composed of legs 45 capable of crossing the two substantially parallel sections 43. The safety latch 43 is also composed of at least two resilient parts 36 on each one of the legs 45. When the legs 45 are crossing the substantially parallel sections 43, the resilient parts 46 are compressed reducing the width of the safety latch 42. When the legs 45 have completely crossed the substantially parallel sections 43, the resilient parts 46 are expanded jamming the safety latch 42 to the plate 18. The hole 8 is set to receive at least a part of the safety latch's legs 45. Finally, the safety latch 42 comprises a head 47 which has a substantially oval shape and which closes the door 1 with pressure force to the dryer's 2 cabinet.

Figure 9:
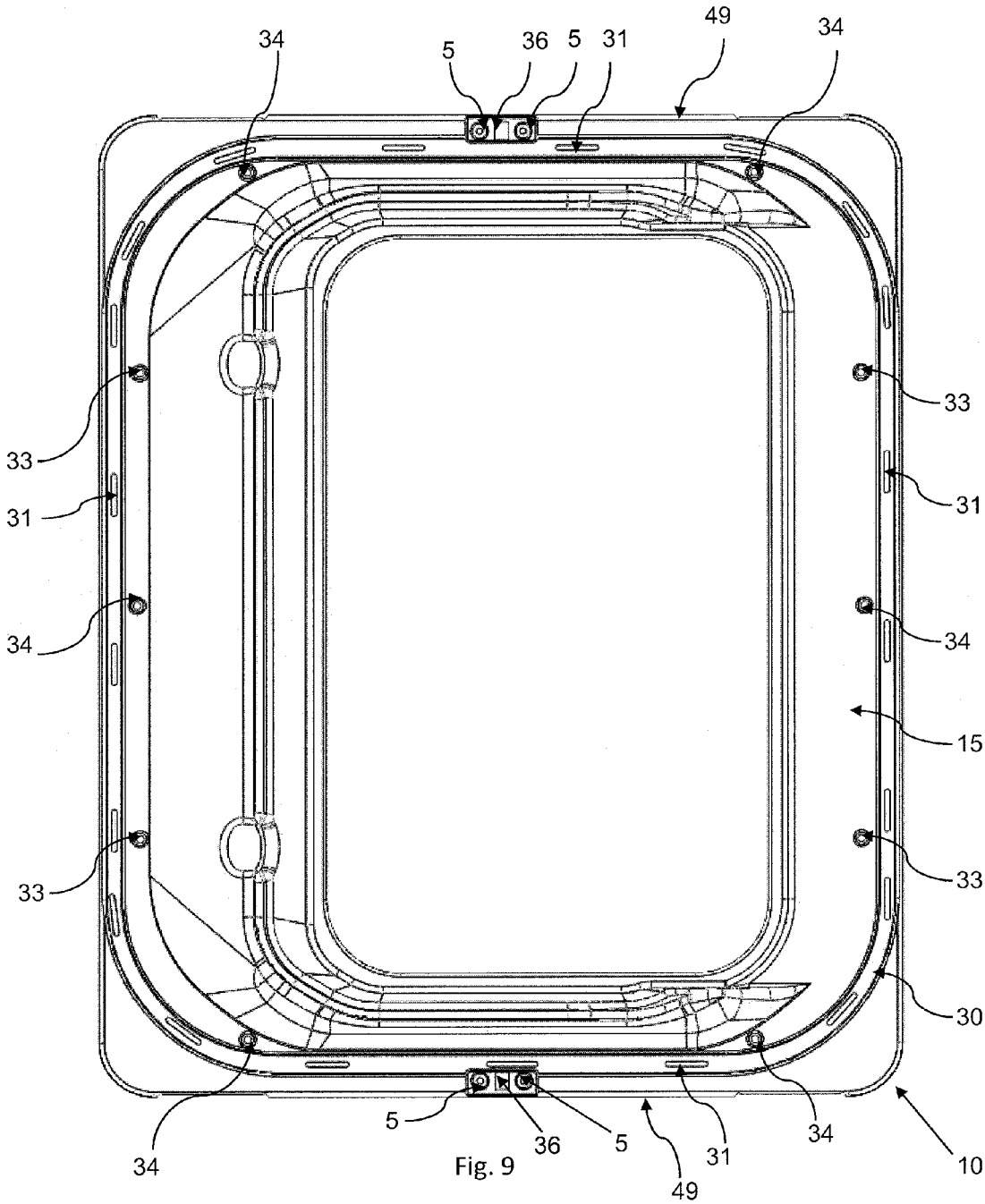
FIG. 9 is a frontal view of the inner face of the inner frame.
Figure 10:
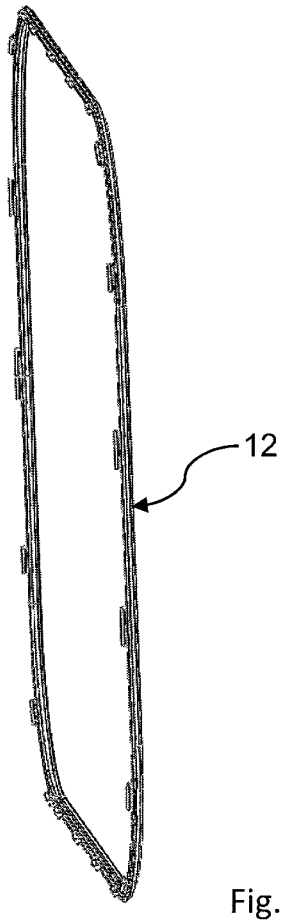
FIG. 10 is a view in conventional perspective of the seal used on the inner face of the inner frame.
Figure 10A:
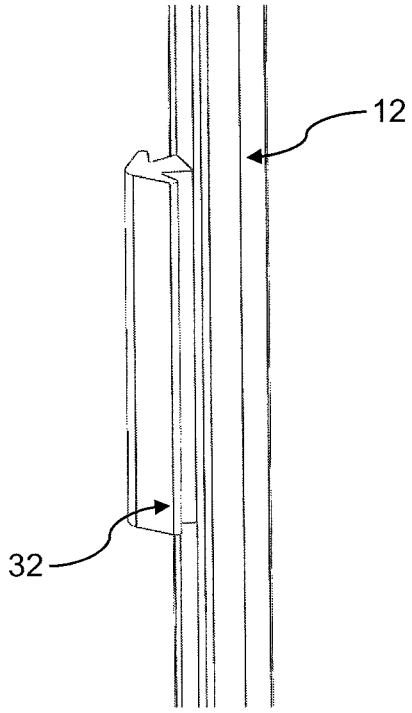
FIG. 10A is a view of a detail of FIG. 10.

FIG. 9 shows the outer face 15 of the inner frame 10. A gutter 30 can be seen which runs along the length and the width of the inner frame 10, over which the second seal 12 or silicon strip 80 is placed. Along the length of the gutter, grooves 31 are seen over which, the seal anchors 32, such as can be seen in FIGS. 10 and 10A, are inserted. This will allow proper fastening and will avoid the detachment of the second seal 12 in relation to the gutter 30 and more generally regarding the inner frame 10. Alternatively, if the silicon strip 80 is installed over the gutter 30, then the grooves can be excused.

Similarly, FIG. 9 shows that in the inner frame 10, specifically close to the border between the front wall and the lateral wall, a series of compression retainer holes 33 are provided as well as assembly holes 34. At least four compression retainer holes 33 are destined to receive and fasten, by means of fastening means 4, the retainers 13, and as a consequence, the tempered glass 3. On the other hand, at least six assembly holes 34 are destined to receive and fasten, by means of fastening means the outer frame 20.

Figure 11:
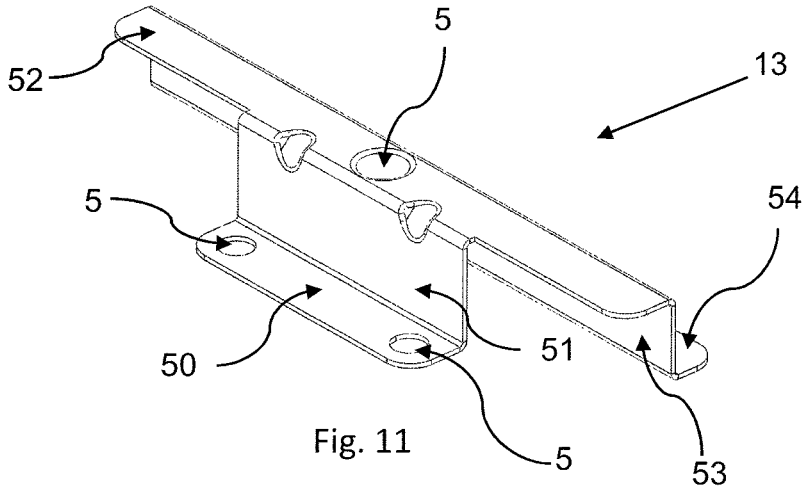
FIG. 11 is a view in conventional perspective of the retainer.
Figure 11A:
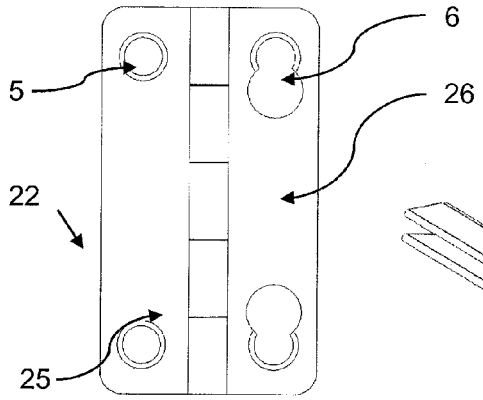
FIG. 11A is a frontal view of the hinge used for the present invention.

FIG. 11 is a detailed view of the retainers 13. The retainer 13 is made up of five distinctive parts. A first part 50 contains at least two holes 5 which shall receive locators of the outer frame 20. A second part 51 is substantially transversal to the first part. A third part 52 substantially parallel to the first part 50 and consequently substantially transversal to the second part 51, which contains at least one hole 5 placed there to receive a fastening means which crosses the compression retainer hole 33 on the inner frame 10. Thus, the hole 5 on the third part 52 and the compression retainer holes 33 on the inner frame 10 are collinear when the door 1 is mounted. A fourth part 53 which is substantially transversal to the first and third parts 50, 52 is substantially parallel to the second part 51. Finally, a fifth part 54 which is substantially parallel to the first and third part 50, 52, is placed to press the tempered glass pane 3 by means of the packaging 16. Upon fastening the retainer 13 to the inner frame 10 by means of a means of fastening 4, specifically by means of the hole 5 on the third part 52 and the compression retainer hole 33 on the inner frame 10, the fastening means 4 tends to bring near the retainer 13 to the inner frame 10, creating a pressure force between the fifth part 54 and the packaging 16, and consequently between the fifth part 54 and the tempered glass pane 3.

Figure 12:
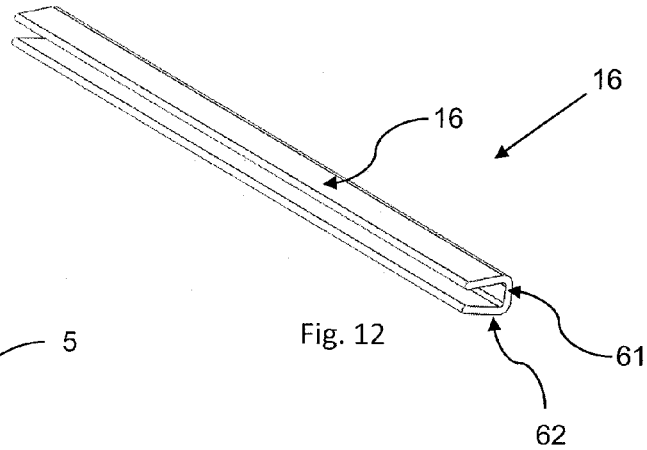
FIG. 12 is a view in conventional perspective of the packaging between each one of the retainers and the tempered glass.
Figure 13:
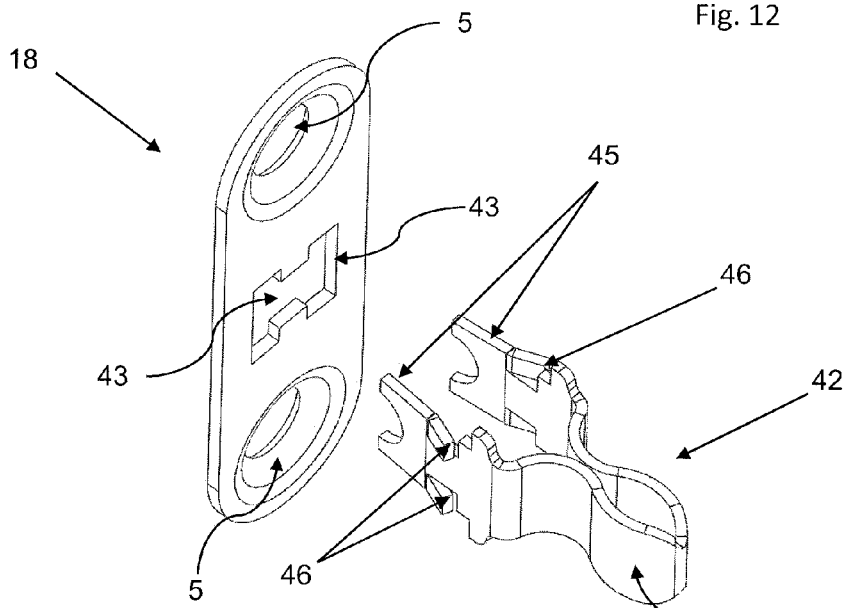
FIG. 13 is a view in conventional perspective of a plate with a safety latch for the present invention.

The packaging 16 is shown in a detailed view in FIG. 12. The packaging 16 is configured to embrace at least partly, the border of the tempered glass pane 3. So that, the packaging 16, has a first section 60, a second section 61 substantially perpendicular to the first section 60, and a third section substantially parallel to the first section 60 and substantially perpendicular to the second section 61. Thus, a form in a substantially "C" section is provided for the packaging 16, even though the shape of the packaging can acquire other shapes already known and used in previous art.

Figure 15:
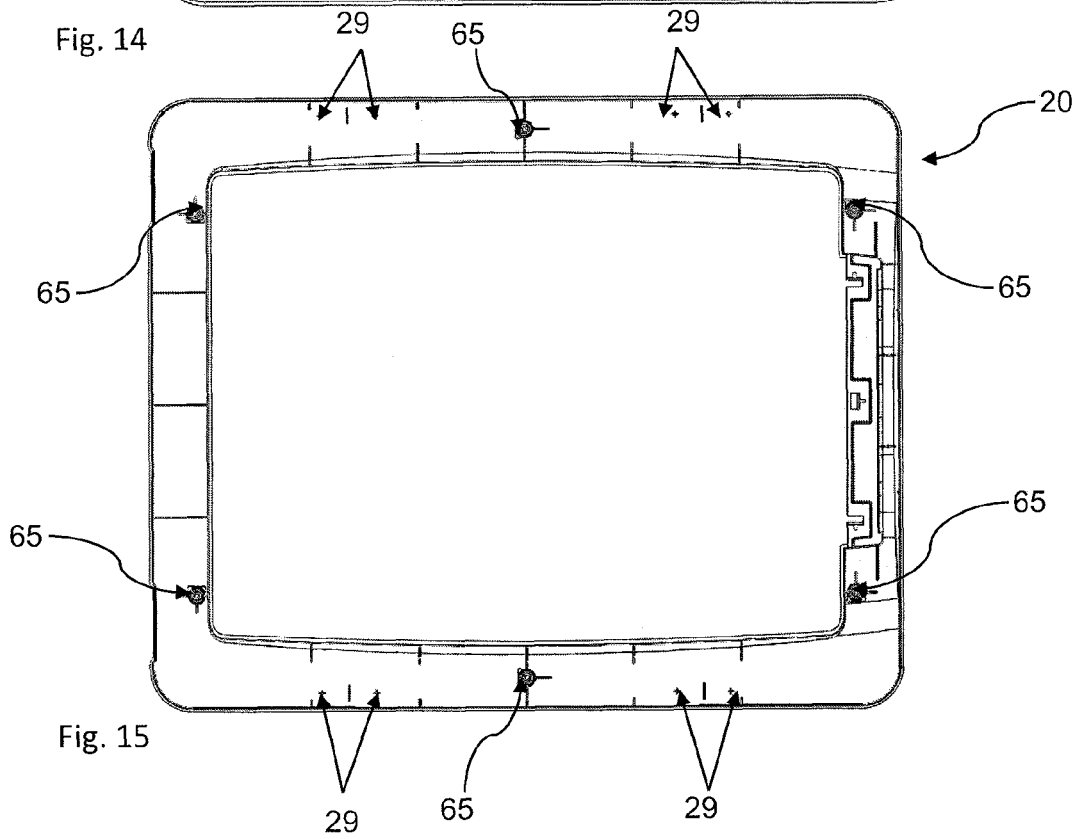
FIG. 15 is a back view of the outer frame of the door or cover of the present invention.
Figure 16:
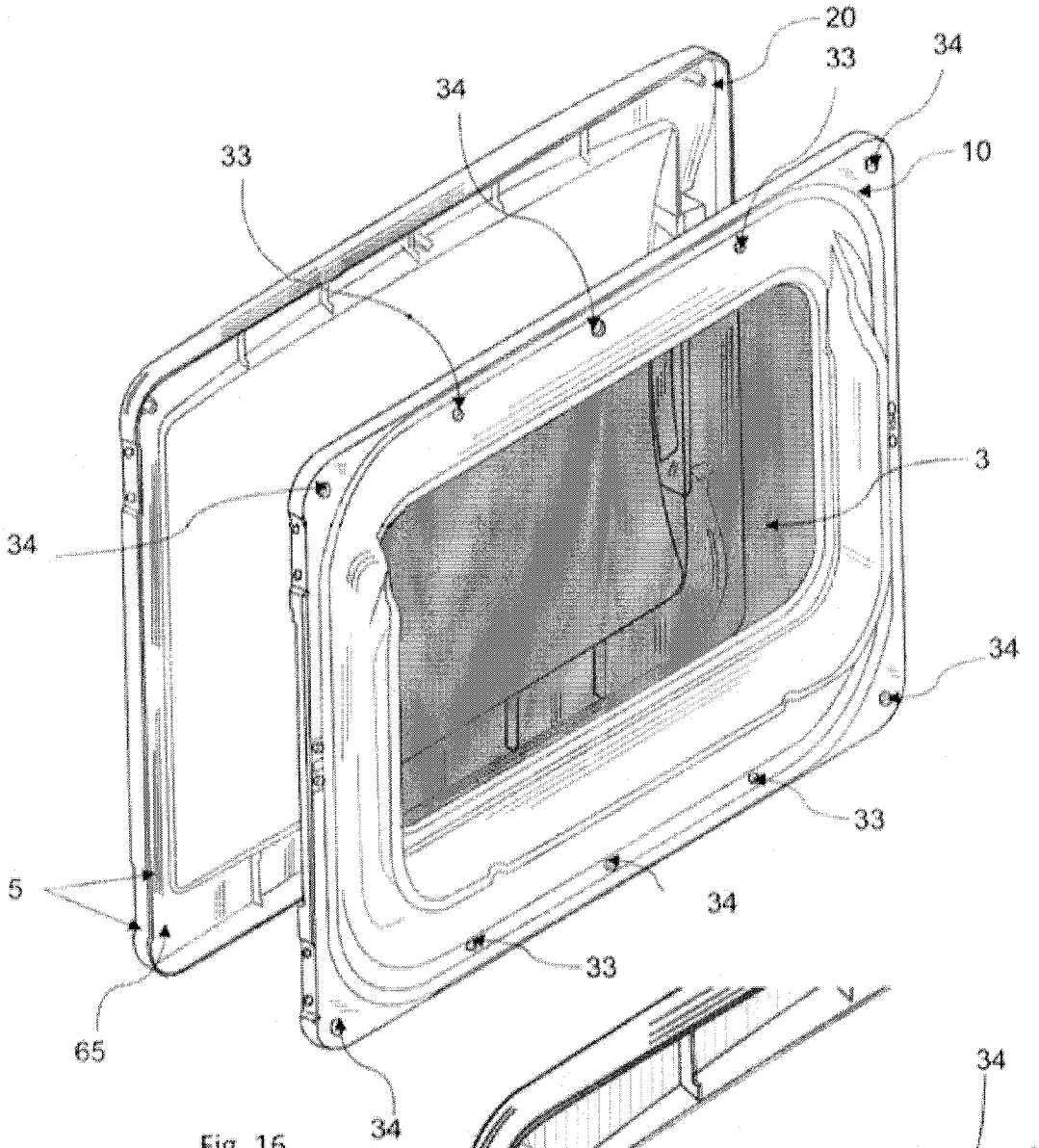
FIG. 16 is an exploded view showing how the inner frame, the tempered glass and the outer frame are joined.
Figure 16A:
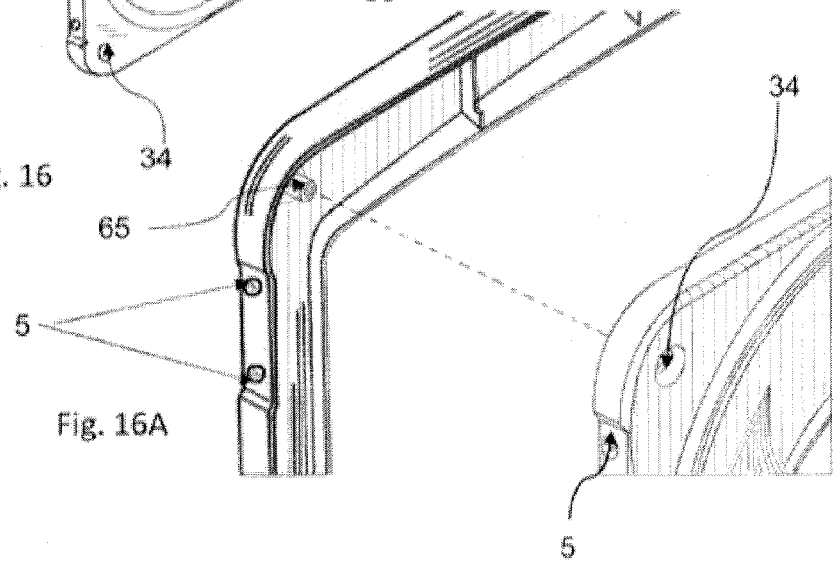
FIG. 16A is a detailed view of FIG. 16.

FIGS. 14 and 15 show a front view and a back view, respectively, of the outer frame 20, while FIGS. 16 and 16A show both frames 10, 20 and the manner in which they are joined. On the outer face, specifically on one of the two lateral parts 27 of the outer face of the outer frame 20, there is a hollow space provided 28 to allow it to mechanically receive the handle 21. On the inner face of the outer frame 20, a locator 29 is provided per each hole 5 present in the first part 50 of the retainer 13. The locators 29 are capable of penetrating said holes 5 in the first part of the retainer for an easy assembly between the outer frame 20 and the assembly of the inner frame 10 and the tempered glass 3. In a similar manner, the outer frame 20 is provided with receptor cavities 65, same which can be threaded and which are set there to receive the fastening means 4 which emanate and penetrate the assembly hole 34 of the inner frame 10. Thus, each assembly hole 34 of the inner frame 10 is found collinear to a receptor cavity 65 of the outer frame 20. Thus, a fastening means 4 penetrates the assembly hole 34 and the receptor cavity 65 and fastens both frames 10, 20.

Figure 17:
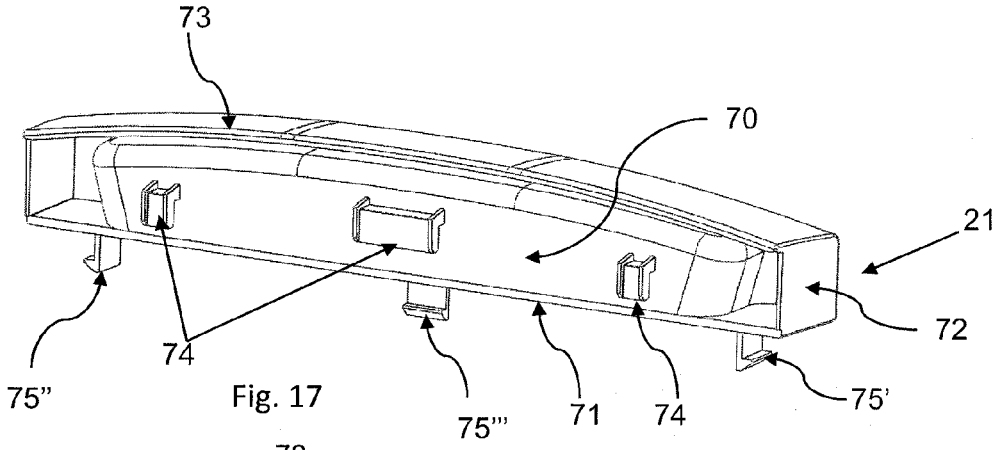
FIG. 17 is a back view of the handle for the door or cover of the present invention.
Figure 18:
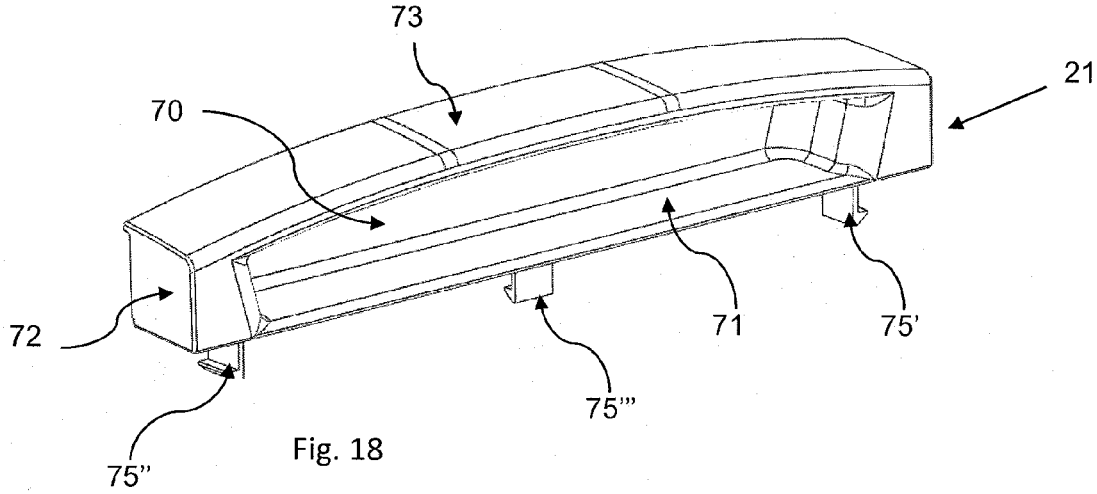
FIG. 18 is a front view of the handle for the door or cover of the present invention.
Figure 19:
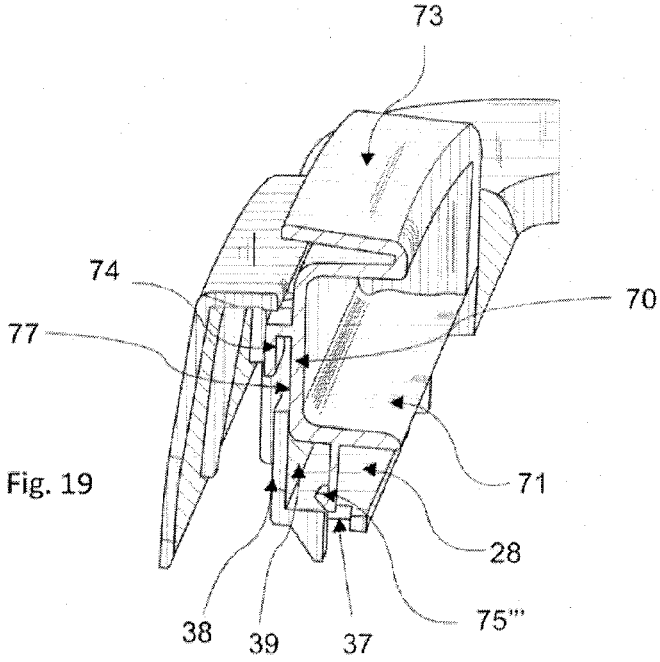
FIG. 19 is a cross section of the handle and of the door or cover of the present invention.

FIGS. 17 and 18 show the handle 21 form a back and front view, while FIG. 19 shows a cross section of a substantially central part of the handle 21 being assembled in the hollow space 28 over the lateral part 27 of the outer frame 20. On the back wall 70 of the handle 21, there are at least three fasteners 74 in a substantially hook-like shape. The hooks of the three fasteners 74 are substantially in the same direction, that is, in a direction substantially towards the door's 1 interior. Equally, on the lower wall 71, there are at least three fasteners 75 in a substantially hook-like shape. The hook of the first fastener 75' is in a substantially lower direction regarding the door 1. The hook of the second fastener 75" is in a substantially opposed direction than that of the first fastener 75'. The hook of the third fastener 75"' is in a substantially outwardly direction regarding the door 1. Such as shown in FIG. 19, the hollow space 28 provided on the lateral side 24 of the outer frame 20, is composed of two transverse walls 38, 39, where each wall is provided with perforations 37 which receive said fasteners 74, 75. The handle is composed of the back wall 70, a lateral wall 72, a lower wall 71 as well as an upper wall 73. To assemble the handle 21 to the hollow space 28 of the outer frame 20, the fasteners 74 are inserted to the back wall 70 within the wall perforations 38 of the hollow space, that is, the handle 21 is inserted in a direction substantially towards the door's 1 exterior; followed by, the fasteners 75 are placed in the perforations of the wall 39 and a push force is exerted towards the doors' 1 interior, until the hook of the fasteners 75 is fastened to the ends of the wall perforations 39. In this way, the handle 21 is fastened to the hollow space 28 and more specifically to the outer frame 20.

Assembly Methods, Methods to Reverse the Door and Industrial Application

Assembly Methods of the First Embodiment

The assembly method of the first embodiment begins by mechanically assembling the handle 21 to the hollow space 28 of the outer frame 20. Subsequently, it is placed on the holes 5 of the first part 50 of the retainer 13 on the locators 29 of the inner face of the outer frame 20. The packaging 16 is placed on the borders of the tempered glass pane 3, borders of tempered glass pane 3 which subsequently are allowed to rest on the fifth part 54 of the retainer 13. Both seals are applied 11, 12 on the respective faces 14, 15 of the inner frame 10. The inner frame 10 is allowed to rest on the tempered glass pane 3; specifically the second seal 12 is allowed to rest the tempered glass pane 3. The co linearity between the hole 5 of the second part 52 of the retainer is checked against the compression retainer hole 33 of the inner frame 10. A fastening means 4 penetrates the compression retainer hole 33 of the inner frame and the hole 5 of the second part of the retainer 13. By this fastening means, the co linearity between the assembly hole 34 of the inner frame 10 and the receptor cavity 65 of the outer frame is assured. Additionally, by way of this fastening means, a seal has been created between the second seal 12 and the tempered glass pane 3. Subsequently, a fastening means 4 penetrates the assembly hole 34 of the inner frame 10 and the receptor cavity 65 of the outer frame 20. The three relevant parts of the door 1 assembly have been fastened between themselves. The hinges 22 are placed on the door assembly, in view of a fastening means 4, which penetrates the holes 5 provided on the lateral part of both frames 10, 20, same which are collinear. Both plates 17, 18 are fastened unto the receptor space 48 by means of the respective receptor cavities. The door 1 assembly is mounted unto the dryer's 2 cabinet by means of the first part 25 of the hinge 22.

Assembly Method of the Second Embodiment

The assembly method of the second embodiment begins by mechanically assembling the handle 21 to the hollow space 28 of the outer frame 20. Subsequently, over the gutter 30 of the inner frame 10, the silicon strip 80 is placed under the conditions previously mentioned. The tempered glass pane 3 is rested on the silicon strip 80 of the inner frame 10 and is allowed to be cured according to the conditions previously described. The first seal 11 is placed over the inner face 14 of the inner frame 10. By means of this curing a seal has been formed between the strip 80 and the tempered glass pane 3. An outer frame 20 is placed over the inner frame 10, thus assuring co linearity between the assembly holes 34 and the receptor cavities 65. Subsequently, a fastening means 4 penetrates the assembly hole 34 of the inner frame 10 and the receptor cavity 65 of the outer frame 20. The three relevant parts of the door assembly 1 have been fastened amongst themselves. The hinges 22 are placed on the door assembly, in view of a fastening means 4, which penetrates the holes 5 provided on the lateral part of both frames 10, 20, same which are collinear. The latch 42 is placed on the plate 18. Both plates 17, 18 are fastened unto the receptor space 48 by means of the respective receptor cavities. The door 1 assembly is mounted unto the dryer's 2 cabinet by means of the first part 25 of the hinge 22.

Method for Door Reversal

Figure 20:
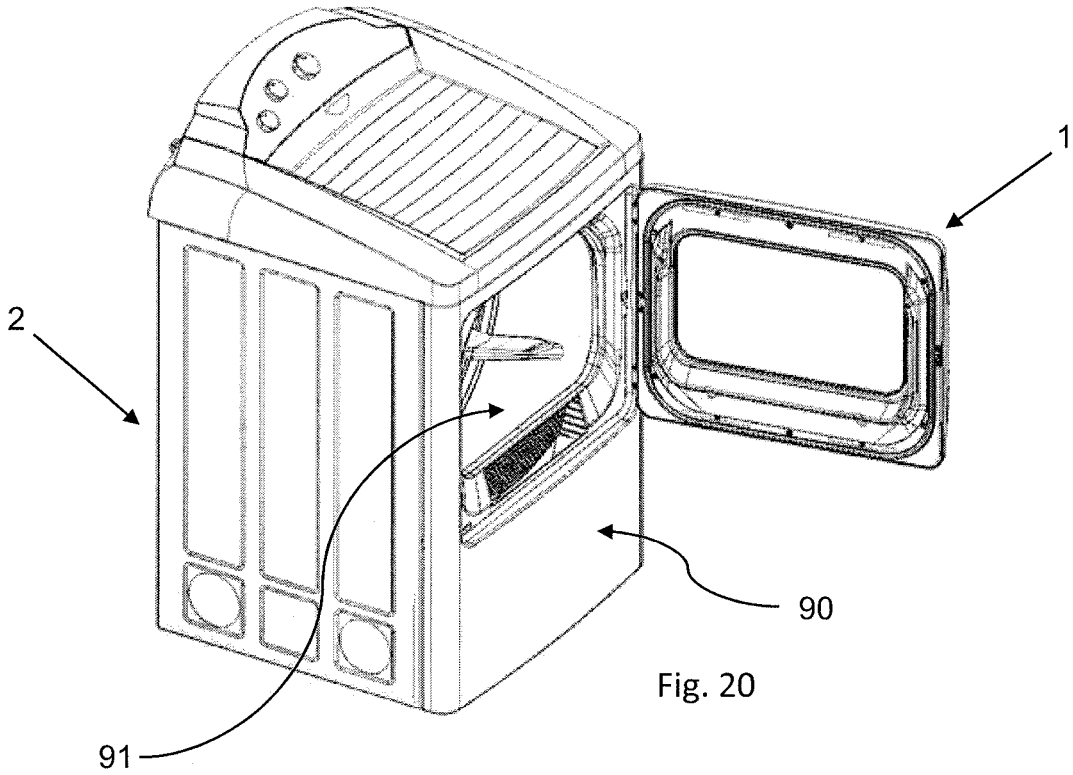
FIG. 20 is a conventional view in perspective of a dryer with the door or cover of the present invention.
Figure 21:
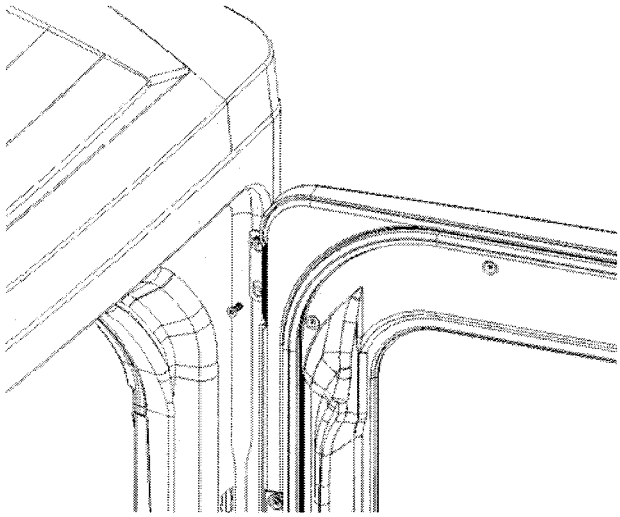
FIG. 21 shows an initial step of the reversibility of the door or cover of the present invention.
Figure 22:
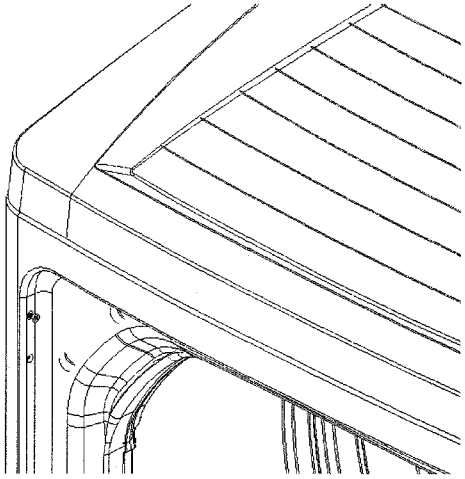
FIG. 22 shows a second step of the reversibility of the door or cover of the present invention.
Figure 23:
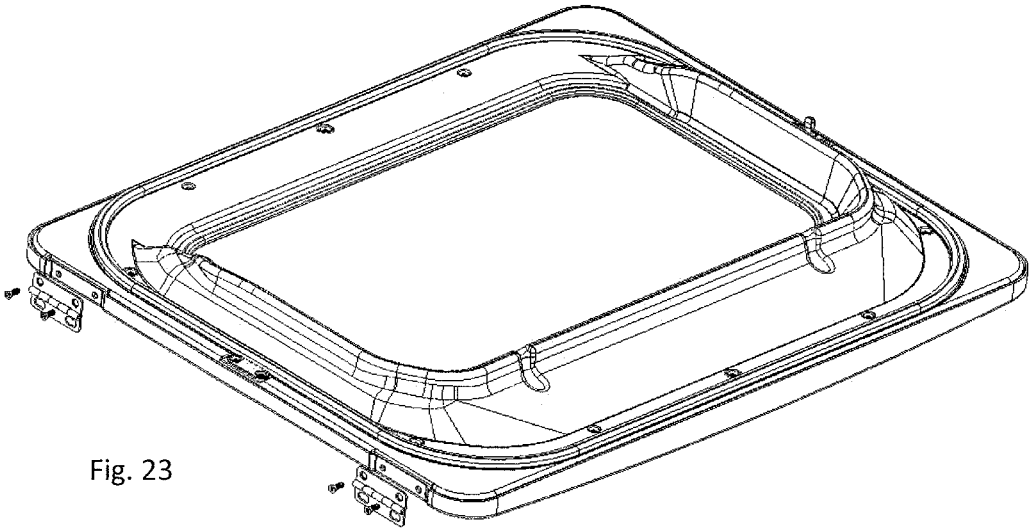
FIG. 23 shows a third step of the reversibility of the door or cover of the present invention.
Figure 24:
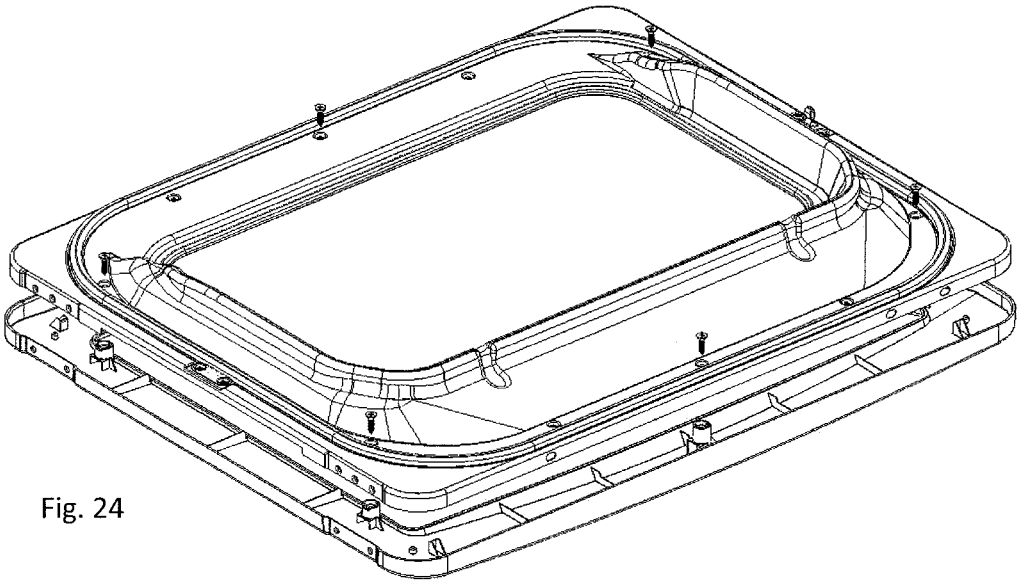
FIG. 24 shows a fourth step of the reversibility of the door or cover of the present invention.
Figure 25:
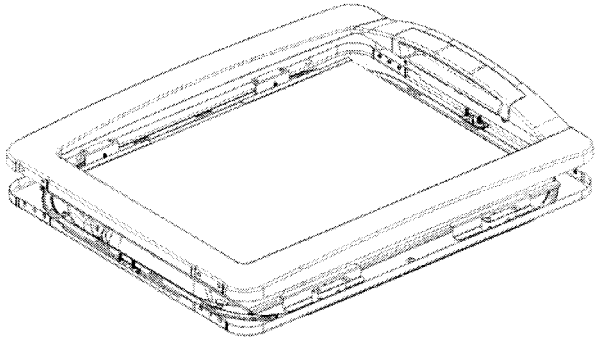
FIG. 25 shows a fifth step of the reversibility of the door or cover of the present invention.
Figure 26:
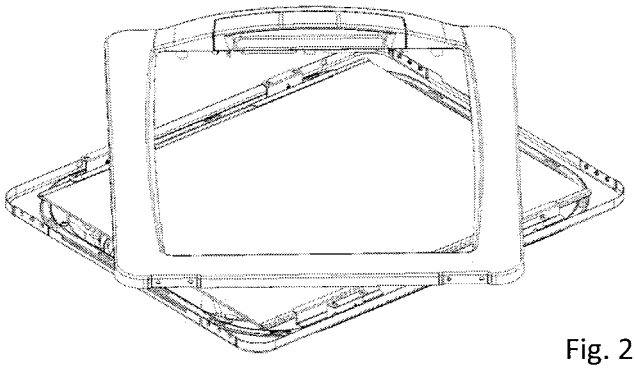
FIG. 26 shows a sixth step of the reversibility of the door or cover of the present invention.
Figure 27:
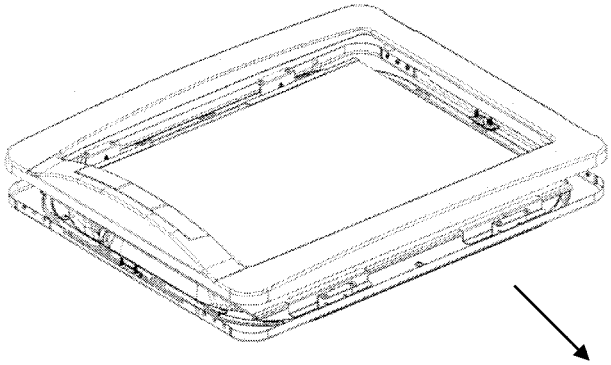
FIG. 27 shows a seventh step of the reversibility of the door or cover of the present invention.
Figure 28:
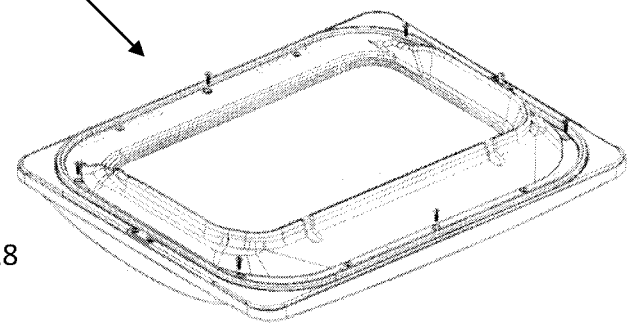
FIG. 28 shows an eight step of the reversibility of the door or cover of the present invention.
Figure 29:
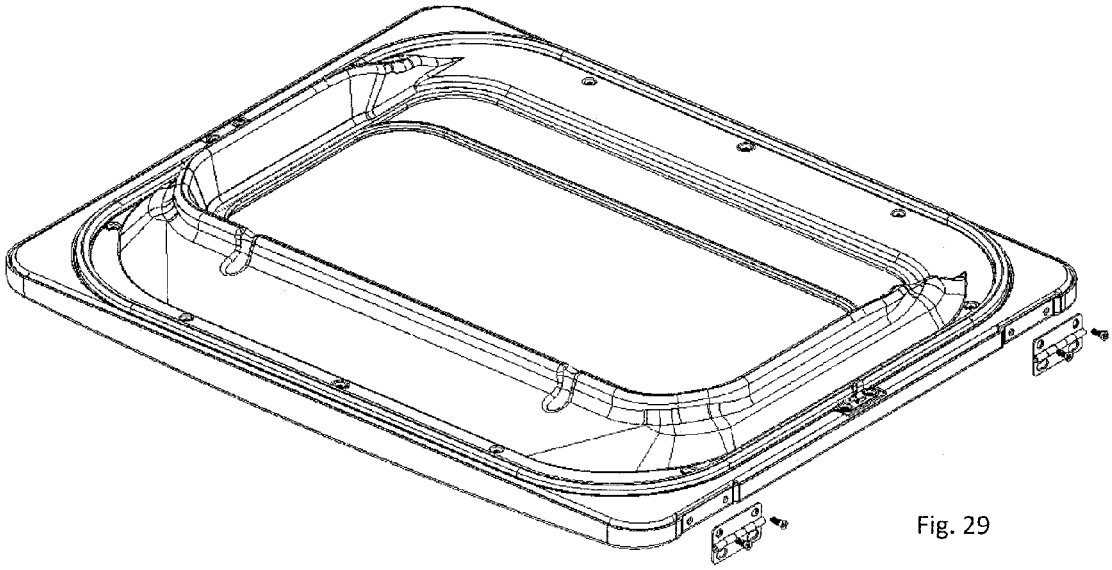
FIG. 29 shows a ninth step of the reversibility of the door or cover of the present invention.
Figure 30:
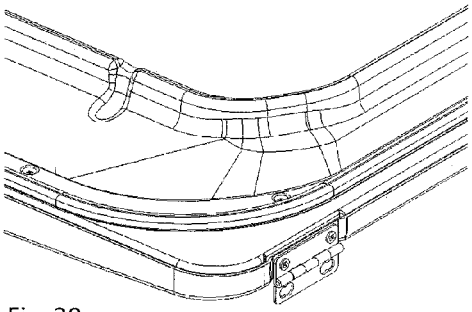
FIG. 30 is a detailed view of FIG. 29.
Figure 31:
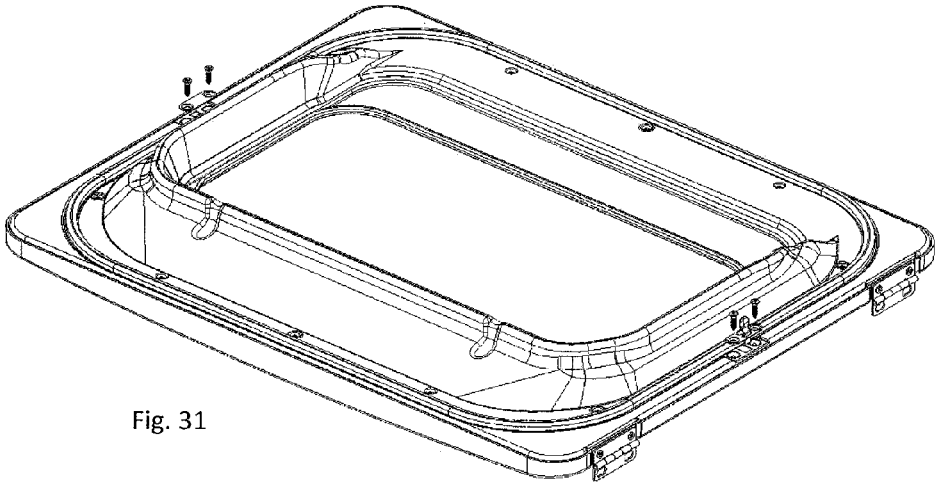
FIG. 31 shows a tenth step of the reversibility of the door or cover of the present invention.
Figure 32:
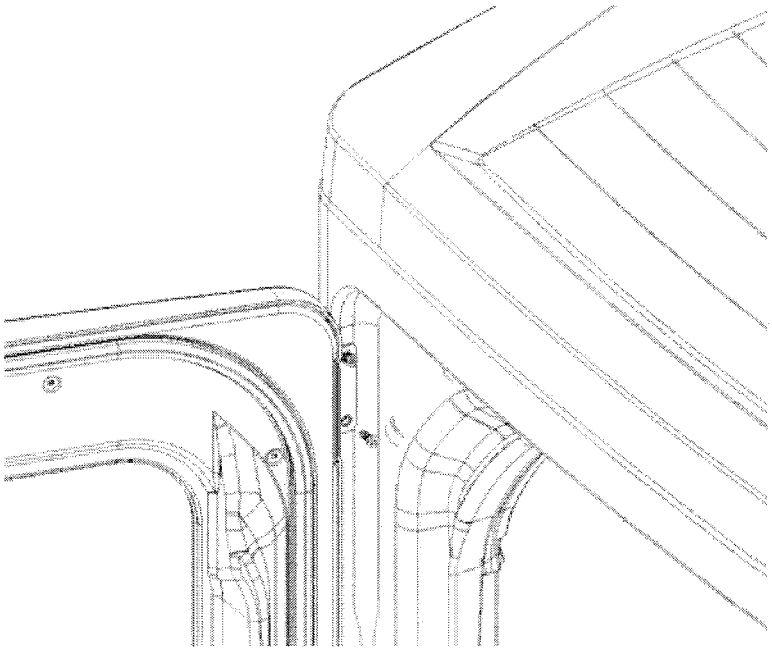
FIG. 32 shows an eleventh step of the reversibility of the door or cover of the present invention.
Figure 33:
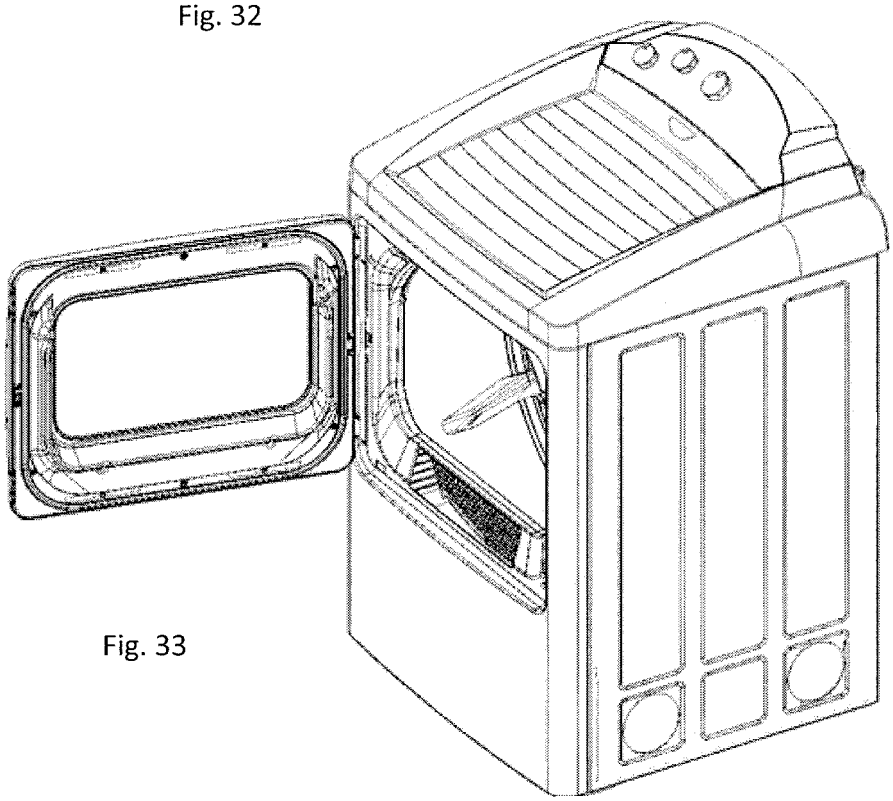
FIG. 33 shows the reversed door or cover of the present invention.

The following description shall reference FIGS. 20 through 33. FIG. 20 shows a dryer 2 with a door 1 which opens by rotating on an axis generally in a first direction. FIG. 21 is a detailed view of the section shown in FIG. 20.

As a first step, and in a way to ensure the door reversal, it is checked that the dryer be unplugged from the power source. The door 1 is rotated approximately 90 degrees in relation to the door's 1 closed position and specifically in relation to the front wall 90 of the dryer's 2 cabinet. The fastening means 4 which are found on the lower part of the first part 25 are removed from each one of the hinges 22. These fastening means are inserted into approximately half of the upper holes are inserted per each hinge 22 on the opposite side of the dryer's 2 mouth 91. The fastening means 4 of both hinges 22 are detached. The door 1 is unlocked raising the door in an upwards direction and afterwards toward the outside. The fastening means which remain on the side of the dryer's 2 mouth 91 are removed, where the door 1 has just been removed. With the door 1 assembly facing downwards, that is, the outer frame 20 faces the floor, on a flat and protected surface, the fastening means 4 are removed from the assembly holes 34 and the receptor cavity 65, as well as the fastening means 4 which join the hinges 22 with the frames 10, 20 are removed. The outer frame 20 is removed from the inner frame 10 by pulling the outer frame 20 from the inner frame 10. The outer frame 20 is rotated 180 degrees in relation to the inner frame 10. The exterior panel 20 is placed in such a way that the assembly holes 34 and the receptor cavities 65 be collinear. The fastening means 4 are secured once again to fasten the hinges 22 to the frames 10, 20 on the lateral sides of the frames, being careful that the second part 26 is close to the door assembly 1 and that the first part 25 is free temporarily. The fastening means 4 are placed once again in such a way that they penetrate the assembly holes 34 and the receptor cavities 65. Both plates 17, 18 are removed from the inner frame 10 and their position inverted. They are fastened once again to the plates 17, 18. They are inserted into the hole 6 of the first part 25 in the fastening means previously set on the opposite side of the dryer's 2 mouth 91 where the door assembly 1 was originally set, and the door is allowed to fall. The door is secured to the dryer's 2 cabinet and the remaining fastening means are installed.

INDUSTRIAL APPLICATION

Such as was previously stated, the door 1 of the present invention is targeted for household appliances. The preferred household appliances of the present invention are dryers 2, such as can be seen in FIG. 1. However, other household appliances which use heat as their means of firing or drying may be included, such as ovens, dishwashers and industrial textile dryers.

Alterations to the structure described in the present, can be foreseen by those experts in the field. However, it should be understood that the present description is related with the preferred embodiments of the invention which is for the sole purposes of illustration and should not be construed as a limitation of the invention. All modifications which do not depart from the spirit of the invention are included within the body of the attached claims.

The invention claimed is:

1. A door with a window for an appliance, the door comprising:
   a) an outer frame to house the window, said outer frame having at least one pair of locators;
   b) a glass pane having at least two mutually opposite borders;
   c) at least one pair of packaging structures arranged to engage the mutually opposite borders of the glass pane;
   d) at least two retainers respectively comprising three parts:
      a first retainer part to couple the at least two retainers to the locators,
      a second retainer part to receive the borders of the glass pane, and supporting the packaging structures,
      a third retainer part including a hole arranged to receive a first fastening means;
   e) an inner frame to further house the window, wherein said inner frame comprises an inner face and an outer face, a first gutter disposed on the outer face, the first gutter located proximate to the window and receiving a first seal, a second gutter having grooves and disposed on the inner face, a periphery of the second gutter located proximate to an outer periphery of the inner frame, wherein said second gutter receives a second seal affixed to the second gutter by anchors in the grooves, the inner frame further comprising at least a pair of compression retainer holes arranged to receive the first fastening means and at least two pairs of assembly holes arranged to receive a second fastening means to form a joined assembly of the inner frame to the outer frame;
   e) at least one plate to support a safety latch, said plate being fastened over an edge of the inner face of the inner frame; and
   f) at least one hinge fastened to a border of the assembly of the inner frame and the outer frame, wherein said border is opposite to the edge of the inner face of the inner frame.

2. The door of claim 1, wherein the appliance comprises a household electric appliance and further comprising a handle placed on the outer face of the outer frame.

3. The door of claim 1, wherein the appliance comprises a household electric appliance, wherein the hinge comprise a first hinge part which latches to the border of the outer frame and inner frame assembly, and a second hinge part which in turn comprises a first hole and a second hole adjacent to one another, the first hole having a greater diameter than the second hole and through which a fastening means is received to couple said second hinge part to a cabinet of the household electric appliance, and further wherein the inner frame has at least one receptor cavity on each lateral side of the inner frame.

4. The door of claim 3, wherein the hinges and the inner frame allow bidirectional pivotal movement to the door.

5. The door of claim 1, wherein the appliance comprises a household electric appliance and further comprising a second plate fastened to the edge of the inner face of the inner frame.

6. A clothes dryer comprising a cabinet having the door of claim 1.

7. An assembly method for a door with a window in an appliance, the method comprising:

a) providing an outer frame to house the window, said outer frame having at least one pair of locators;

b) providing at least two respective retainers respectively comprising three retainer parts:

c) coupling a first retainer part to a corresponding locator of the outer frame;

d) providing a glass pane having at least two mutually opposite borders, which are engaged by at least one pair of packaging structures;

e) receiving the mutually opposite borders of the glass pane by a second retainer part, which supports a corresponding packaging structure;

f) providing an inner frame to further house the window, disposing on an outer face of said inner frame a first gutter located proximate to the window, disposing on an inner face of said inner frame a second gutter with grooves, locating a periphery of the second gutter proximate to an outer periphery of the inner frame;

g) housing a first seal in the first gutter;

h) housing a second seal in the second gutter and affixing the second seal to the second gutter by anchors in the grooves;

i) passing through at least one pair of compression retainer holes, a first fastening means and subsequently passing the first fastening means through a hole located in a third retainer part of the at least two retainers;

j) passing a second fastening means through at least two pairs of assembly holes to form a joined assembly of the inner frame to the outer frame;

k) fastening at least one plate which supports a safety latch on an edge of the inner face of the inner frame; and l) fastening at least one hinge to a border of the assembly of the inner frame and the outer frame, said border being opposite to the edge of the inner face of the inner frame.

* * * * *

UNITED STATES PATENT AND TRADEMARK OFFICE

CERTIFICATE OF CORRECTION

PATENT NO. : 8,523,300 B2
APPLICATION NO. : 13/110128
DATED : September 3, 2013
INVENTOR(S) : Najera Bernal et al.

It is certified that error appears in the above-identified patent and that said Letters Patent is hereby corrected as shown below:

In the Claims

Column 12, line 53, Claim 1, delete "e" and insert -- f --.

Column 12, line 56, Claim 1, delete "f" and insert -- g --.

Signed and Sealed this
Nineteenth Day of November, 2013

Teresa Stanek Rea

Teresa Stanek Rea
*Deputy Director of the United States Patent and Trademark Office*